US010927779B2

(12) United States Patent
Bonkoski et al.

(10) Patent No.: US 10,927,779 B2
(45) Date of Patent: Feb. 23, 2021

(54) CAMSHAFT PHASER CONTROL FOR VARIABLE DISPLACEMENT ENGINES

(71) Applicant: Ford Global Technologies, LLC, Dearborn, MI (US)

(72) Inventors: Phillip Bonkoski, Ann Arbor, MI (US); Amey Karnik, Canton, MI (US); William Cunningham, Milan, MI (US); Gregory McConville, Ann Arbor, MI (US); Kim Hwe Ku, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 341 days.

(21) Appl. No.: 15/899,920

(22) Filed: Feb. 20, 2018

(65) Prior Publication Data

US 2019/0257257 A1 Aug. 22, 2019

(51) Int. Cl.

| | |
|---|---|
| ***F02D 41/00*** | (2006.01) |
| ***F01L 1/344*** | (2006.01) |
| ***F02B 75/18*** | (2006.01) |
| ***F02D 41/24*** | (2006.01) |
| *F01L 1/18* | (2006.01) |
| *F01L 13/00* | (2006.01) |
| *F01L 1/24* | (2006.01) |

(52) U.S. Cl.

CPC ..... *F02D 41/0082* (2013.01); *F01L 1/344* (2013.01); *F01L 1/3442* (2013.01); *F01L 1/34409* (2013.01); *F02B 75/18* (2013.01); *F02D 41/2409* (2013.01); *F01L 1/2405* (2013.01); *F01L 13/0005* (2013.01); *F01L 2001/186* (2013.01); *F01L 2001/34453* (2013.01); *F01L 2001/34496* (2013.01); *F01L 2013/001* (2013.01); *F01L 2800/00* (2013.01); *F02D 41/0087* (2013.01)

(58) Field of Classification Search

CPC ..... F01L 1/34409; F01L 1/344; F01L 1/3442; F01L 1/2405; F01L 2001/34496; F01L 2001/186; F01L 2001/34453; F01L 2013/001; F01L 2001/34493; F01L 2001/34486; F02D 41/0082; F02D 41/0087; F02D 41/2409; F02D 13/0219; F02D 13/0207; F02D 13/0215; F02D 2041/001

USPC ..... 123/90.17, 90.15, 90.16, 481, 198 F

See application file for complete search history.

(56) References Cited

U.S. PATENT DOCUMENTS

| | | | | |
|---|---|---|---|---|
| 6,837,231 | B1 * | 1/2005 | Herrin | F02D 41/0082 123/684 |
| 7,835,848 | B1 | 11/2010 | Rollinger et al. | |
| 8,356,583 | B2 | 1/2013 | Smith | |
| 8,498,797 | B2 | 7/2013 | Moriya | |
| 9,200,587 | B2 | 12/2015 | Serrano | |

(Continued)

*Primary Examiner* — Devon C Kramer
*Assistant Examiner* — Kelsey L Stanek
(74) *Attorney, Agent, or Firm* — Geoffrey Brumbaugh; McCoy Russell LLP

(57) ABSTRACT

Methods and systems are provided for controlling camshaft phasers of a variable displacement engine. In one example, the engine includes first and second cylinder banks, with the engine being configured to operate in a rolling variable displacement mode. The camshaft phasers are torque actuated camshaft phasers, and a controller of the engine may adjust operation of camshaft phasers at the first cylinder bank differently than camshaft phasers at the second cylinder bank.

20 Claims, 10 Drawing Sheets

(56) References Cited

U.S. PATENT DOCUMENTS

| | | | | |
|---|---|---|---|---|
| 9,410,453 | B2 | 8/2016 | Rollinger et al. | |
| 9,650,971 | B2 | 5/2017 | Pirjaberi et al. | |
| 9,677,479 | B2 | 6/2017 | Boyer et al. | |
| 9,739,212 | B1 * | 8/2017 | Srinivasan | F02D 41/0087 |
| 2009/0013947 | A1 * | 1/2009 | Russ | F02D 13/0219 123/90.17 |
| 2013/0245921 | A1 * | 9/2013 | Glugla | F02D 13/0219 701/105 |
| 2016/0108834 | A1 * | 4/2016 | McConville | F02D 13/06 123/90.15 |

* cited by examiner

CAMSHAFT PHASER CONTROL FOR VARIABLE DISPLACEMENT ENGINES

FIELD

The present description relates generally to methods and systems for controlling camshaft phasers of a variable displacement engine.

BACKGROUND/SUMMARY

Intake valves and exhaust valves of engines are often driven by a plurality of camshafts including a plurality of cams. As the camshafts rotate, the cams drive the intake valves and exhaust valves to adjust an amount of opening of the valves with respect to the engine cylinders to which the valves are coupled. Often, engines include systems for variable cam timing (VCT) in order to adjust operation of the intake valves and exhaust valves in response to engine operating conditions. For example, a phase of the camshafts, with respect to the rotation of the camshafts, may be shifted (advanced or retarded) by the VCT systems in order to adjust intake valve and/or exhaust valve opening and closing timing, thereby controlling a flow of fresh intake air to engine cylinders and/or a flow of combusted exhaust gases from the engine cylinders. Adjusting the timing of the intake valves and exhaust valves via the camshafts may adjust an amount of work produced by combustion of fuel and air within the engine cylinders, enabling increased control of engine operation.

Often, VCT systems are configured to include electrically actuated camshaft phasers that are energizable via control signals transmitted to the phasers by an electronic controller of the engine. However, electrically actuated camshaft phasers may consume relatively large amounts of electrical current with respect to other components of the engine due to consumption of electrical power each time the camshaft phasers adjust the rotation of their respective coupled camshafts, increasing an operating load of the engine. Alternately, some VCT systems include hydraulically actuated camshaft phasers that are fed pressurized engine oil via an engine oil pump. The pressurized engine oil enables the camshaft phasers to adjust the rotation of the camshaft; however, at lower engine speeds, engine oil pressure may be insufficient to operate the camshaft phasers. Additionally, the size of the engine oil pump delivering engine oil to the camshaft phasers is often increased in order to ensure that the engine oil is sufficiently pressurized at higher engine speeds to enable operation of the camshaft phasers, with the increased size of the engine oil pump increasing a load on the engine and reducing engine performance.

Attempts to address the issues with the VCT systems described above include utilizing camshaft phasers that are actuated by forces resulting from engagement of the cams of the camshafts with the intake valves and exhaust valves. One example approach is shown by Moriya in U.S. Pat. No. 8,498,797. Therein, a control apparatus for an internal combustion engine is disclosed, with the control apparatus including a variable valve operating mechanism which changes a valve characteristic of an engine valve, with the variable valve operating mechanism operating via torque supplied by cams of the camshafts. The control apparatus further includes a valve stop mechanism which stops opening/closing of the engine valve in at least one cylinder. A valve timing control prohibition routine prohibits adjustment of valve operation by the variable valve operating mechanism during conditions in which a pressure of hydraulic fluid supplied to the variable valve operating mechanism is less than a determined pressure.

However, the inventors herein have recognized potential issues with such systems. As one example, stopping an opening and closing of an engine valve (for example, an intake valve) for at least one cylinder of an engine may adversely affect operation of a variable valve operating mechanism controlling the engine valve in different ways depending on a configuration of the engine. For example, during conditions in which several cylinders of the engine are deactivated by stopping the opening and closing of their associated intake valves and exhaust valves, torque supplied to the variable valve operating mechanism by engagement of cams of the camshafts of the engine with the intake valves and exhaust valves may be decreased. However, adjustment of the valves via the variable valve operating mechanism may be desirable during such conditions, and prohibiting valve adjustment as described in the '797 patent may result in decreased engine efficiency and/or performance.

In one example, the issues described above may be addressed by a method, comprising: controlling phasing of a first camshaft coupled to a first bank of an engine via a first phase timer; controlling phasing of a second camshaft coupled to a second bank of the engine via a second phase timer; and correcting the first and second phase timers by first and second corrections each based on an induction ratio of the engine, the first and second corrections being different for the same induction ratio. In this way, the camshaft phasers may be operated more consistently at a wider variety of engine induction ratios.

As one example, the engine may include a large number of possible engine induction ratios resulting from cylinder deactivation due to cylinders being disposed within each of the first bank and the second bank. The first phase timer and second phase timer may each be torque actuated phase timers, and correcting the first and second phaser timers by different first and second corrections enables the phase rates of the phase timers to be approximately a same amount for each induction ratio. Overall, the phase rates may be increased, resulting in increased engine performance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for controlling cam torque actuators of intake and exhaust valves of a variable displacement engine. A variable displacement engine, such as the engine shown by FIG. 1, includes a plurality of cylinders having intake valves and exhaust valves driven by rotation of cams coupled to engine camshafts. Operation of the intake valves and exhaust valves may be selectably adjusted by an electronic controller of the engine in order to activate and/or deactivate one or more engine cylinders. Additionally, a phase of the rotation of the camshafts relative to a rotation of a crankshaft of the engine may be adjusted by one or more camshaft phasers, such as the camshaft phasers shown by FIGS. 2 and 3A-3B, in order to advance or retard an opening and closing timing of the intake valves and exhaust valves.

Figure 4:
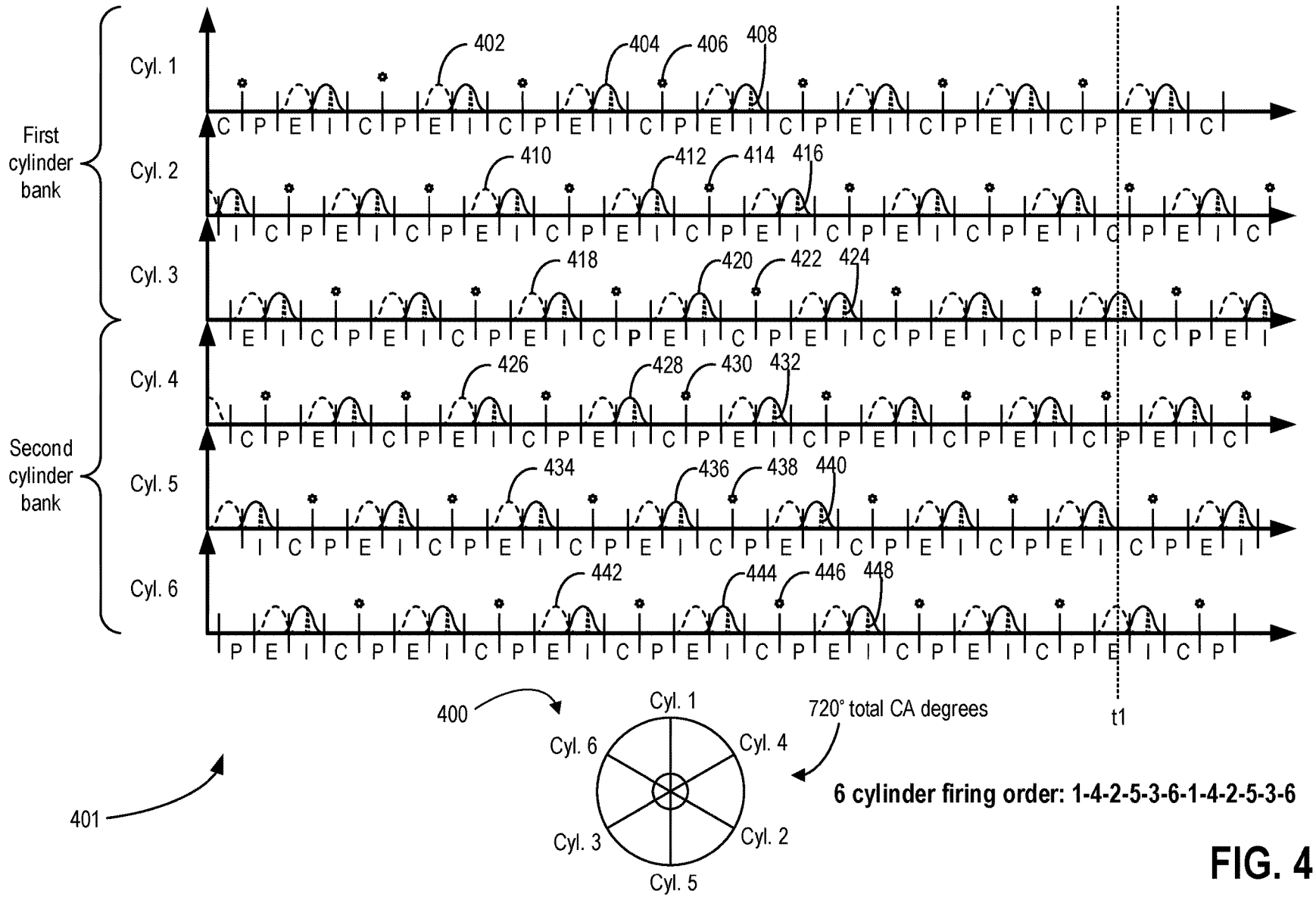
FIG. 4 shows an ignition timing and combustion cycle of an engine including six cylinders, with each cylinder in an activated mode.
Figure 5:
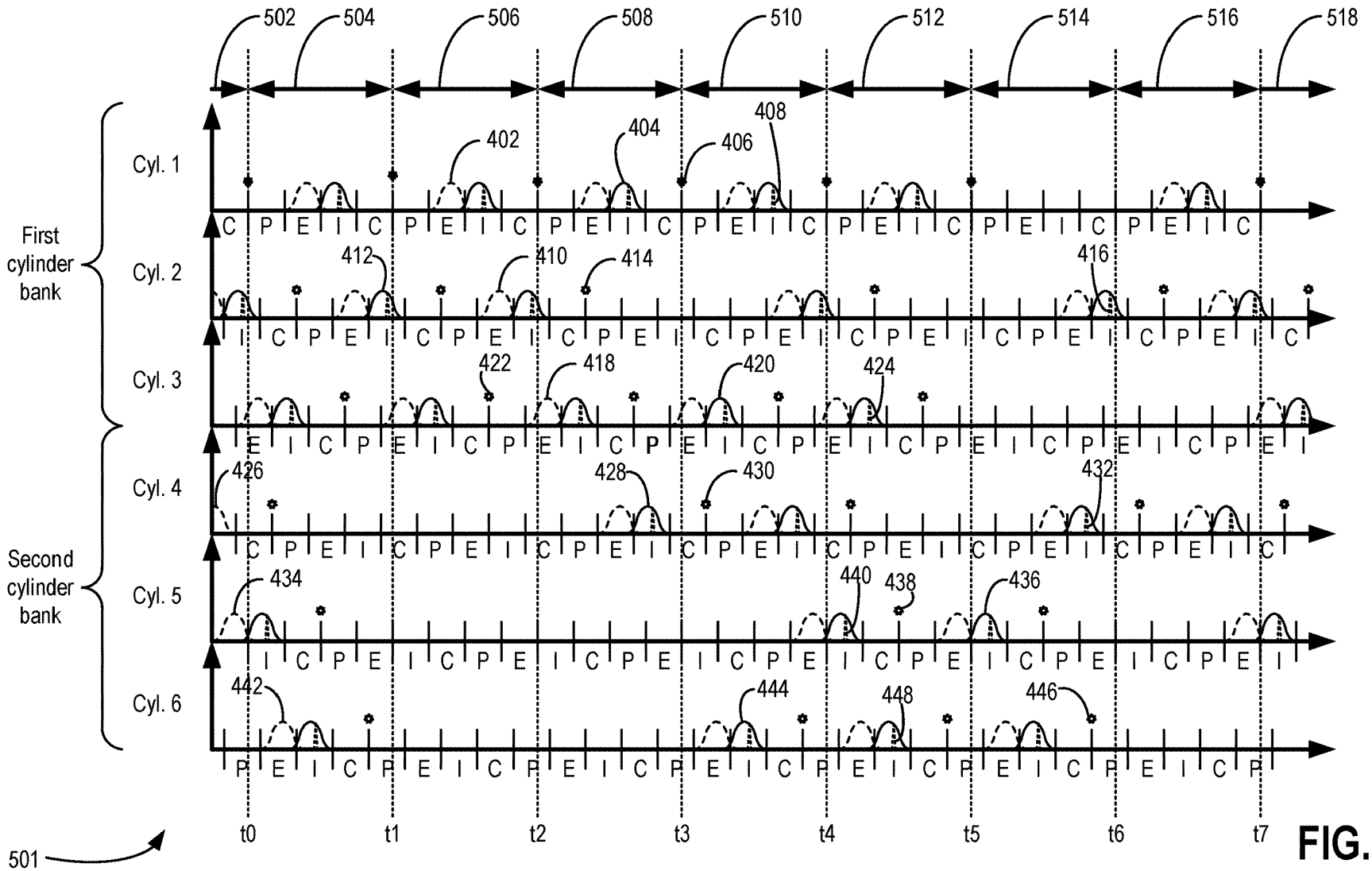
FIG. 5 shows an ignition timing and combustion cycle of an engine including six cylinders, with the engine operating at various engine induction ratios via cylinder deactivation.
Figure 6:
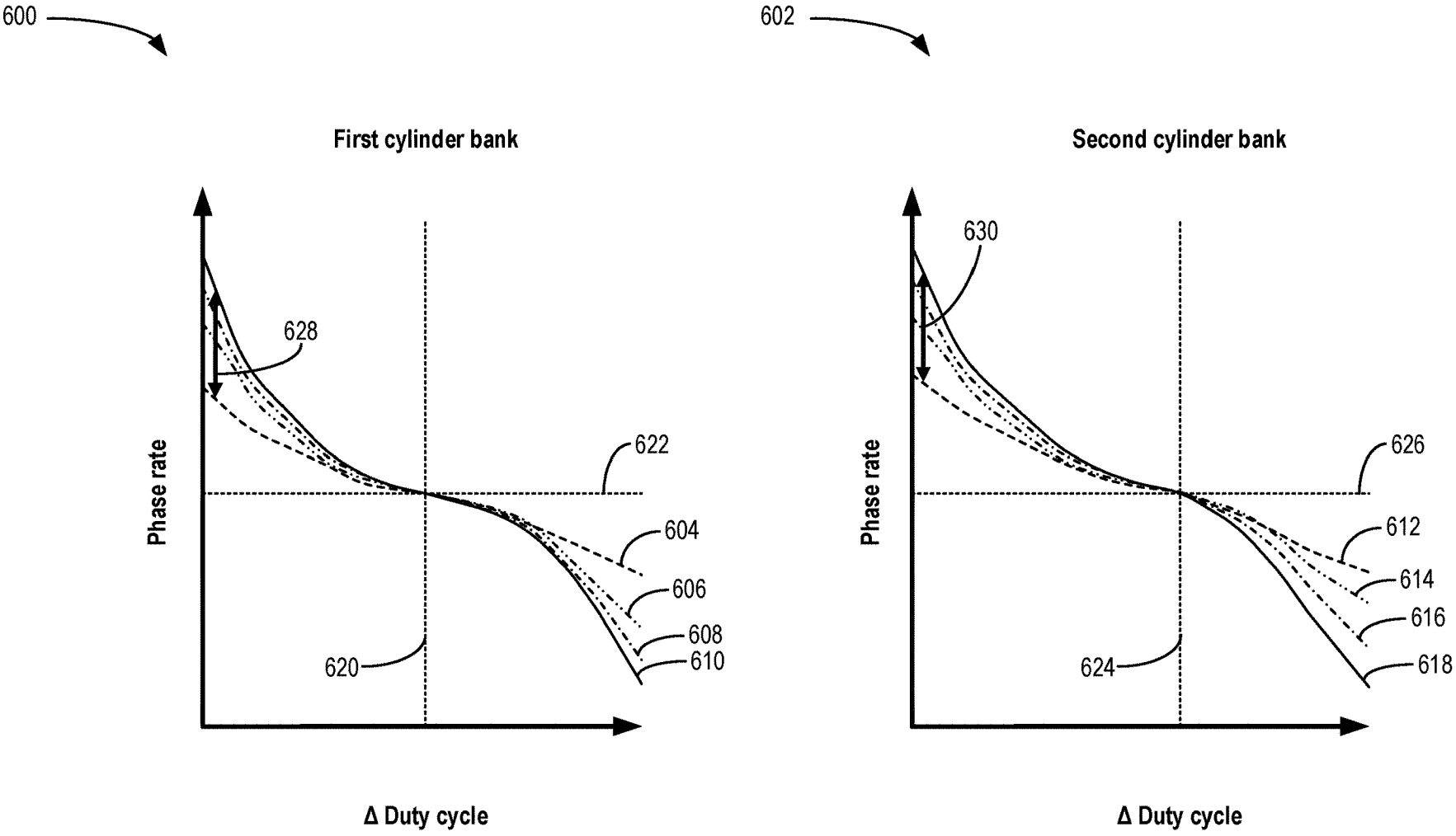
FIG. 6 shows a first graph illustrating a phase rate of a first camshaft phaser of a first cylinder bank relative to adjustments to a duty cycle of a control valve of the first camshaft phaser, and a second graph illustrating a phase rate of a second camshaft phaser of a second cylinder bank relative to adjustments to a duty cycle of a control valve of the second camshaft phaser, with the first camshaft phaser and second camshaft phaser not adjusted based on engine induction ratio.
Figure 7:
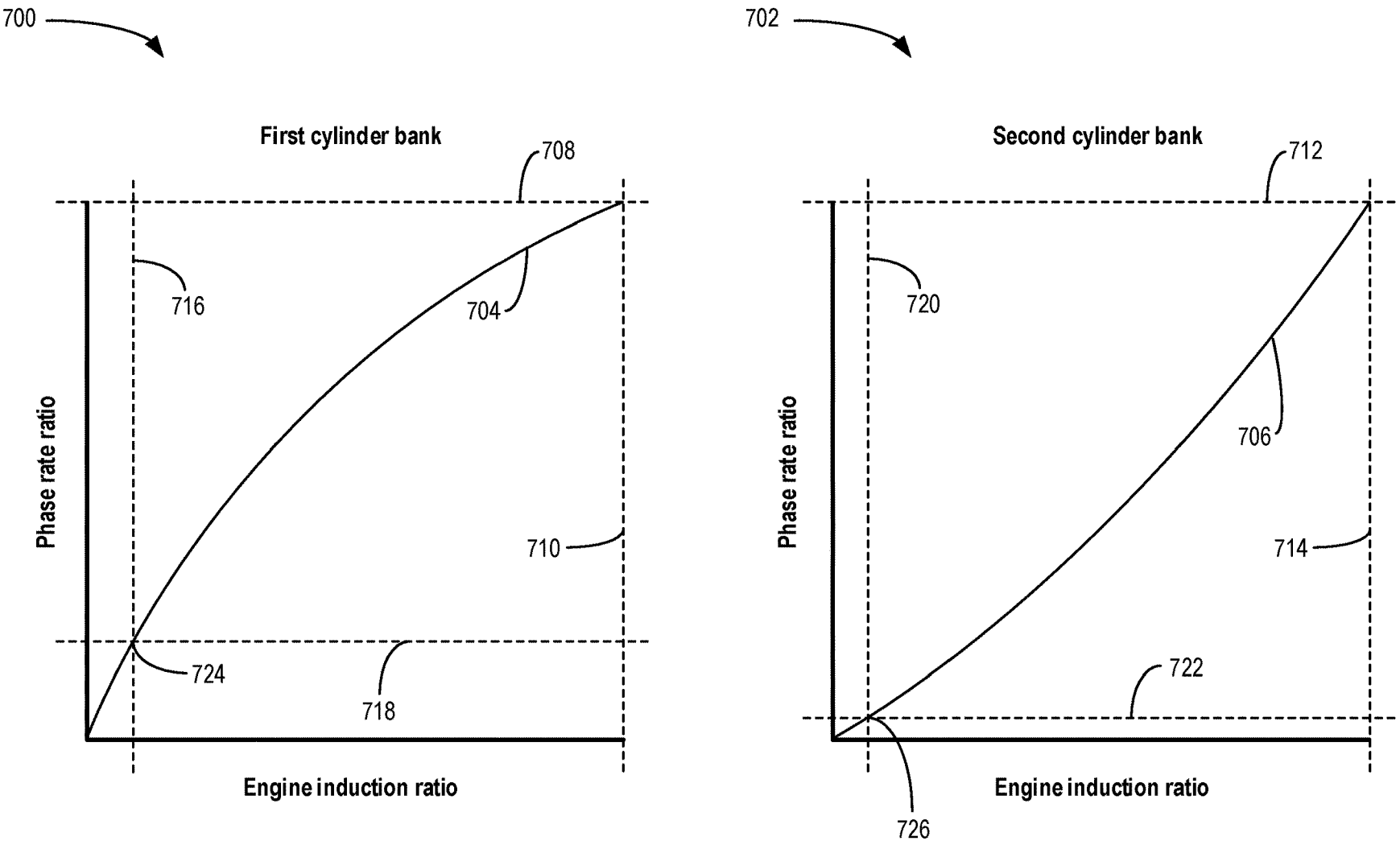
FIG. 7 shows graphs illustrating a phase rate ratio relative to engine induction ratio for the first and second cylinder banks.
Figure 8:
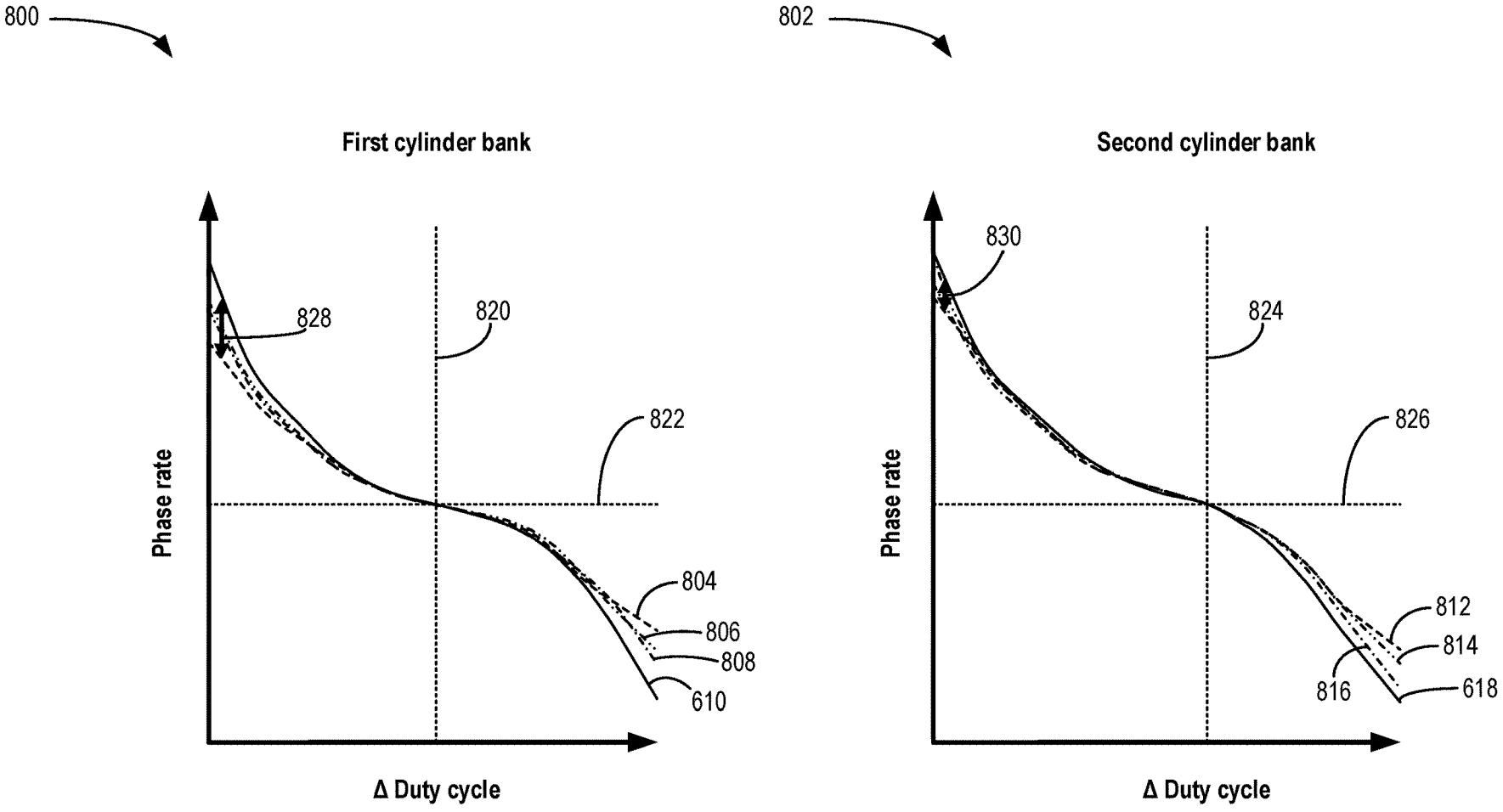
FIG. 8 shows a first graph illustrating an adjusted phase rate of the first camshaft phaser of the first cylinder bank relative to adjustments to an adjusted duty cycle of the control valve of the first camshaft phaser, and a second graph illustrating an adjusted phase rate of the second camshaft phaser of the second cylinder bank relative to adjustments to an adjusted duty cycle of the control valve of the second camshaft phaser, with the first camshaft phaser and second camshaft phaser being adjusted based on engine induction ratio.

The engine may be a V-engine having cylinders arranged in separate cylinder banks. The engine may operate in a mode in which each of the cylinders is activated, as illustrated by FIG. 4. Additionally, the engine may operate in a rolling pattern variable displacement mode in which the electronic controller may selectively deactivate one or more cylinders, as shown by FIG. 5. The electronic controller adjusts operation of the camshaft phasers of the separate cylinders banks based on an induction ratio of the engine, as described by the methods of FIGS. 9-10. Adjusting operation of the camshaft phasers of the separate cylinder banks based on the induction ratio may result in a more consistent phase rate of the phasers at different induction ratios, as shown by FIG. 8, relative to operating the engine without adjusting the operation of the camshaft phasers based on the induction ratio, as illustrated by FIG. 6. Operation of camshaft phasers of a first cylinder bank may be adjusted differently than operation of camshaft phasers of a second cylinder bank based on the same induction ratio, as illustrated by FIG. 7. As a result, the camshaft phasers may operate more consistently for a wide variety of induction ratios and engine configurations, and engine performance may be increased.

Figure 1:
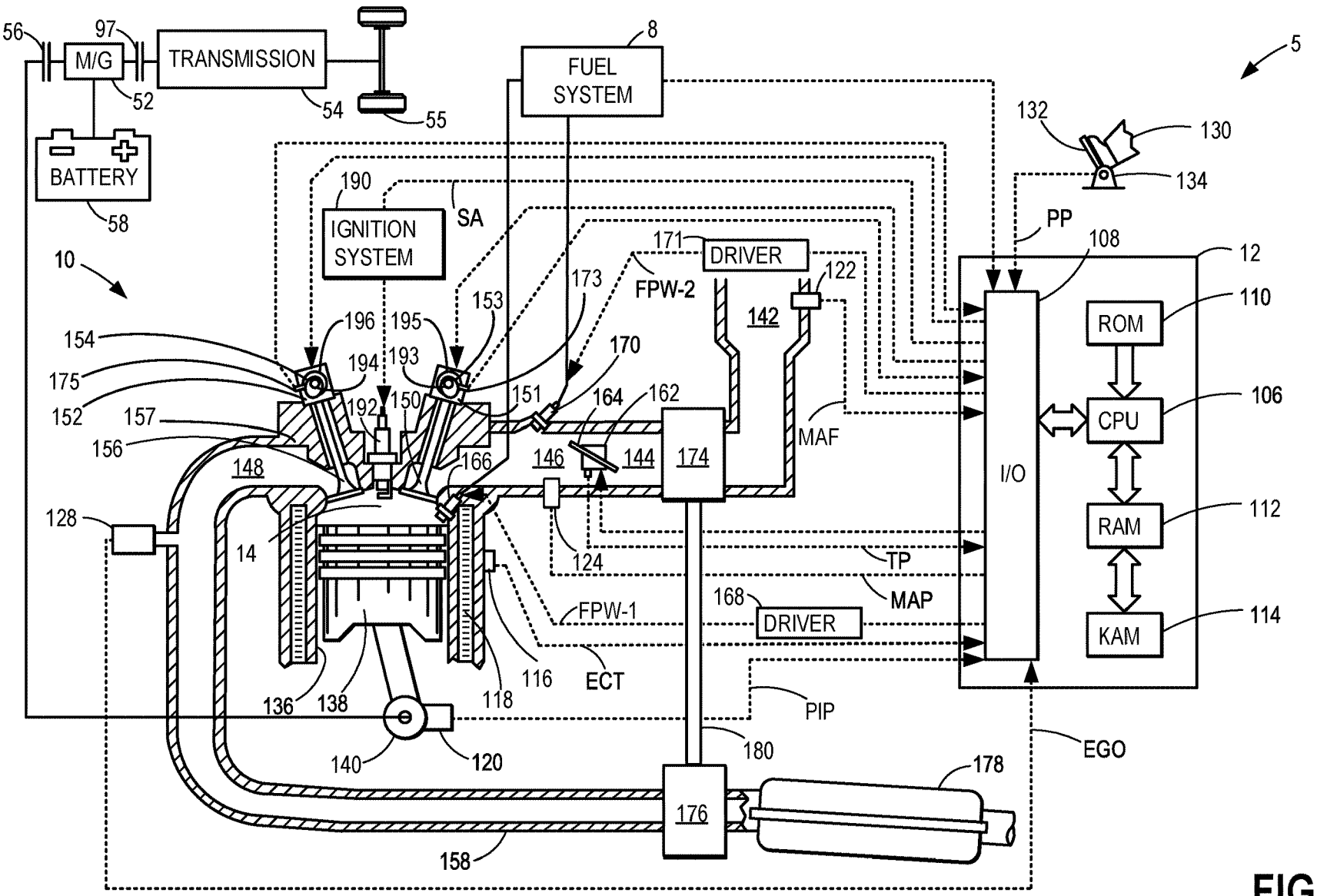
FIG. 1 schematically shows an engine including cam torque actuated camshaft phasers.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. The cylinder 14 is capped by cylinder head 157. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

In the example of FIG. 1, intake valve 150 and exhaust valve 156 are actuated (e.g., opened and closed) via respective cam actuation systems 153 and 154. Cam actuation systems 153 and 154 each include one or more cams mounted on one or more camshafts. Cam actuation system 153 and cam actuation system 154 each include a variable cam timing (VCT) system that may be operated by controller 12 to vary valve operation, as described further below.

Further, one or both of cam actuation system 153 and cam actuation system 154 may utilize one or more of cam profile switching (CPS) and/or variable valve lift (VVL) systems that may be operated by controller 12 to vary valve operation. The angular position of intake and exhaust camshafts may be determined by position sensors 173 and 175, respectively. For example, position sensors 173 and 175 may Hall Effect sensors, optical sensors, or the inductive sensors configured to detect a position and/or rotational speed of the intake and exhaust camshafts of the engine, and to transmit signals (e.g., electrical signals) to the controller 12 in order to indicate the detected position and/or rotational speed. In alternate embodiments, one or more additional intake valves and/or exhaust valves of cylinder 14 may be controlled via electric valve actuation. For example, cylinder 14 may include one or more additional intake valves controlled via electric valve actuation and one or more additional exhaust valves controlled via electric valve actuation.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 housed within cylinder head 157 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics, such as differences in size. For example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as Eli) (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches are engaged. In the depicted example, a first clutch 56 is provided between crankshaft 140 and electric machine 52, and a second clutch 97 is provided between electric machine 52 and transmission 54. Controller 12 may send a signal to an actuator of each clutch (e.g., first clutch 56 and/or second clutch 97) to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

As described above, FIG. 1 shows only one cylinder of multi-cylinder engine 10. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Engine 10 is a variable displacement engine, and operation of the cylinder 14 may be adjusted by the controller 12. For example, one or more valves of the cylinder 14 (e.g., intake valve 150 and/or exhaust valve 156) may be adjustable by the controller 12 from an activated mode to a deactivated mode (and vice versa). In one example, intake valve 150 and exhaust valve 156 may each be coupled to respective deactivatable valve assemblies. In some examples the deactivatable valve assemblies may adjust an operational mode of their corresponding coupled valves in response to signals transmitted to the deactivatable valve assemblies by the controller 12. Intake valve 150 is shown coupled to deactivatable valve assembly 151 and exhaust valve 156 is shown coupled to deactivatable valve assembly 152.

In some examples, the controller 12 may transmit electrical signals to the deactivatable valve assembly 151 in order to adjust the operational mode of the intake valve 150 from an activated mode to a deactivated mode (or vice versa) and/or the controller 12 may transmit electrical signals to the deactivatable valve assembly 152 in order to adjust the operational mode of the exhaust valve 156 from an activated mode to a deactivated mode (or vice versa). For example, the deactivatable valve assembly 151 may include one or more components (e.g., solenoids) that may be energized and/or de-energized in response to electrical signals transmitted to the components by the controller 12 in order to adjust the operational mode of the intake valve 150 (e.g., engage and/or disengage the intake valve 150 with a cam configured to drive the intake valve 150). Similarly, the deactivatable valve assembly 152 may include one or more components that may be energized and/or de-energized in response to electrical signals transmitted to the components by the controller 12 in order to adjust the operational mode of the exhaust valve 156 (e.g., engage and/or disengage the exhaust valve 156 with a cam configured to drive the exhaust valve 156).

In other examples, deactivatable valve assembly 151 and deactivatable valve assembly 152 may be hydraulically actuated in order to adjust the operational mode of the intake valve 150 and exhaust valve 156, respectively. In one example, each of the deactivatable valve assemblies includes a rocker arm coupled to a hydraulic lash adjuster. For example, deactivatable valve assembly 151 may include a hydraulic lash adjuster configured to reduce a lash (e.g., an amount of gap) between the rocker arm and an intake cam of cam actuation system 153. Adjusting a pressure of oil flowing into the hydraulic lash adjuster and/or rocker arm may adjust the hydraulic lash adjuster and/or rocker arm (respectively) from an activated mode to a deactivated mode (and vice versa).

In one example, in the activated mode, the rocker arm of deactivatable valve assembly 151 coupled to the intake valve 150 is pressed into engagement with the intake cam of cam actuation system 153 (e.g., pressed into engagement by the hydraulic lash adjuster) so that a rotational motion of the intake cam of cam actuation system 153 (e.g., rotational motion resulting from a rotation of a camshaft coupled to the intake cam of cam actuation system 153 by the engine 10) is converted into a pivoting motion of the rocker arm, and the pivoting motion of the rocker arm is converted into a linear motion of the intake valve 150. The linear motion of the intake valve 150 enables intake air to flow through the intake air passage 146 and into the cylinder 14. For example, as the intake valve 150 is moved away the cylinder 14 (e.g., towards an opened position), a flow of intake air around the intake valve 150 from the intake air passage 146 and into the cylinder 14 may be increased. As the intake valve 150 is moved toward the cylinder 14 (e.g., towards a closed position), the flow of intake air around the intake valve 150 from the intake air passage 146 and into the cylinder 14 may be decreased. In this way, during conditions in which the intake valve 150 is in the activated mode, movement of the intake valve 150 provides the cylinder 14 with intake air for combustion within the cylinder 14. Similarly, in the activated mode, movement of the exhaust valve 156 (e.g., via deactivatable valve assembly 152) enables combusted fuel/air mixture to be exhausted from the cylinder 14 into exhaust passage 148.

However, in the deactivated mode, the rocker arm coupled to the intake valve 150 is not pressed into engagement with the intake cam of cam actuation system 153 (e.g., not pressed into engagement by the hydraulic lash adjuster). As a result, the rotational motion of the intake cam of cam actuation system 153 is not converted into the pivoting motion of the rocker arm, and the intake valve 150 does not move from the closed position toward the opened position. During conditions in which the intake valve 150 is in the deactivated mode, intake air does not flow into the cylinder 14 (e.g., via the intake passage 146). Similarly, during conditions in which the exhaust valve 156 is in the deactivated mode, combustion gases are not exhausted from the cylinder 14 (e.g., via the exhaust passage 148). By deactivating both of the intake valve 150 and the exhaust valve 156, combustion of fuel/air within the cylinder 14 may be prevented for a duration (e.g., one or more complete cycles of the engine 10). Additionally, during conditions in which both of the intake valve 150 and the exhaust valve 156 are in the deactivated mode, the controller 12 may reduce an amount of fuel provided to the cylinder 14 (e.g., via electrical signals transmitted to fuel injector 170 and/or fuel injector 166) and/or may reduce an amount of spark produced by spark plug 192 disposed within the cylinder 14.

In the example described above, transmitting electrical signals to the deactivatable valve assemblies via the controller may include transmitting electrical signals to one or more hydraulic fluid valves fluidly coupled to the respective hydraulic lash adjusters and/or rocker arms in order to adjust the hydraulic fluid valves to a fully closed position, a fully opened position, or a plurality of positions between the fully closed position and the fully opened position. In some examples, moving the one or more hydraulic fluid valves to an opened position may increase a pressure of oil at the hydraulic lash adjusters and/or rocker arms to operate the cylinder valves (e.g., intake valve 150 and exhaust valve 156) in the deactivated mode, and moving the hydraulic fluid valves to the closed position may not increase the pressure of oil at the hydraulic lash adjusters and/or rocker arms to operate the cylinder valves in the activated mode.

In other examples, as described above with reference to deactivatable valve assemblies including one or more components (e.g., solenoids) that may be energized and/or de-energized in response to electrical signals transmitted to the components by the controller 12, the valves of the deactivatable valve assemblies (e.g., intake valves and/or exhaust valves) may be activated and/or deactivated by the one or more components during conditions in which the one or more components are de-energized or energized, respectively. For example, deactivatable valve assembly 151 may include a solenoid that adjusts the intake valve 150 to the activated mode during conditions in which the solenoid is de-energized (e.g., enables the intake valve 150 to be driven by its respective cam, such that the intake valve 150 is opened and closed by rotation of its respective cam), and adjusts the intake valve to the deactivated mode during conditions in which the solenoid is energized (e.g., does not enable the intake valve 150 to be driven by its respective cam, such that the intake valve 150 remains in the fully closed position throughout an entire rotation of its respective cam).

Although operation of the intake valve 150 is described above as an example, the exhaust valve 156 may operate in a similar way (e.g., with the operational mode of the exhaust valve 156 being adjusted via the deactivatable valve assembly 152).

As described above, cam actuation system 153 and cam actuation system 154 each include a variable cam timing (VCT) system that may be operated by controller 12 to vary valve operation. Specifically, cam actuation system 153 includes an intake camshaft phaser 195, and cam actuation system 154 includes an exhaust camshaft phaser 196. Intake camshaft phaser 195 and exhaust camshaft phaser 196 are each torque-actuated camshaft phasers that utilize torque resulting from valve opening and closing events (e.g., intake valve and/or exhaust valve opening and closing events) to control (e.g., advance and/or retard) a phase of their respective camshaft, as described below. For example, intake camshaft phaser 195 may utilize torque resulting from driving intake valve 150 via the intake cam of intake camshaft 193 to control (e.g., advance and/or retard) the phase of the intake camshaft 193 relative to the crankshaft 140, and exhaust camshaft phaser 196 may utilize torque resulting from driving exhaust valve 156 via the exhaust cam of the exhaust camshaft 194 to advance and/or retard the phase of the exhaust camshaft 194 relative to the crankshaft 140. The camshaft phasers described herein may be referred to as phase timers. For example, cam torque actuated camshaft phaser 200 shown by FIG. 2 may be referred to herein as a cam torque actuated phase timer. Further, a phase direction of a camshaft as described herein refers to an advance direction or retard direction of the camshaft relative to the crankshaft of the engine (e.g., whether a rotational phase of the camshaft is advanced relative to the crankshaft or retarded relative to the crankshaft). The camshaft phasers described herein may adjust the phase direction of the camshaft in the advance direction or retard direction based on a duty cycle of the phasers, as described below (e.g., with reference to the example provided by FIG. 2).

Each of the intake camshaft phaser 195 and exhaust camshaft phaser 196 may include a plurality of internal chambers configured to receive hydraulic fluid (e.g., oil). For example, the intake camshaft phaser 195 may include an advance chamber and a retard chamber formed within a housing of the intake camshaft phaser 195, and the advance chamber and retard chamber may be configured to receive oil in response to actuation of a control valve of the intake camshaft phaser 195. Advancing of the intake camshaft 193 may occur in response to a pressure of hydraulic fluid within the advance chamber of the intake camshaft phaser 195 exceeding a pressure of hydraulic fluid within the retard chamber of the intake camshaft phaser 195. Retarding of the intake camshaft 193 may occur in response to the pressure of hydraulic fluid within the retard chamber of the intake camshaft phaser 195 exceeding a pressure of hydraulic fluid within the advance chamber of the intake camshaft phaser 195. The control valve may be adjusted by the controller 12 in order to adjust the relative pressures of hydraulic fluid within the advance chamber and retard chamber of the intake camshaft phaser 195. An example of an intake camshaft phaser similar to the intake camshaft phaser 195 is described further below with reference to FIGS. 2-3.

Although the configuration of the intake camshaft phaser 195 is described above, the exhaust camshaft phaser 196 includes a similar configuration. For example, the exhaust camshaft phaser 196 includes an advance chamber and a retard chamber disposed within a housing of the exhaust camshaft phaser 196, and the relative hydraulic pressures within the advance chamber and the retard chamber may enable the exhaust camshaft phaser 196 to advance and/or retard the phase of the exhaust camshaft 194 relative to the crankshaft 140.

The controller 12 receives signals from the various sensors of FIG. 1 and employs the various actuators of FIG. 1 to adjust engine operation based on the received signals and instructions stored on a memory of the controller. For example, adjusting the intake valve 150 from the activated mode to the deactivated mode may include adjusting an actuator of the intake valve 150 (e.g., deactivatable valve assembly 151) to adjust an amount of movement of the intake valve 150 relative to cylinder 14. For example (as described above), the controller 12 may transmit electrical signals to a hydraulic fluid valve of the deactivatable valve assembly 151 (with the deactivatable valve assembly 151 coupled to the intake valve 150) in order to move the hydraulic fluid valve of the deactivatable valve assembly 151 from the closed position to an opened position. Moving the hydraulic fluid valve of the deactivatable valve assembly 151 to the opened position may increase a pressure of hydraulic fluid (e.g., oil) at the hydraulic lash adjuster and/or rocker arm of the deactivatable valve assembly 151. The increased pressure results in the rocker arm being disengaged from the intake valve 150, thereby adjusting the intake valve to the deactivated mode. Similarly, the controller 12 may transmit electrical signals to the hydraulic fluid valve of the deactivatable valve assembly 151 in order to move the hydraulic fluid valve to an opened position and thereby adjust the intake valve 150 to the activated mode. Adjusting the rocker arms between the activated mode and deactivated mode may adjust one or more corresponding cylinders of the engine from an activated mode to a deactivated mode (and vice versa).

In another example, the controller 12 may transmit electrical signals (e.g., pulse width modulated actuating signals) to the control valve of the intake camshaft phaser 195 in order to control (e.g., adjust) the relative pressure of hydraulic fluid within the advance chamber and retard chamber of the intake camshaft phaser 195, and adjusting the relative pressure of the hydraulic fluid via the controller may advance and/or retard the phase of the intake camshaft 193 relative to the crankshaft 140. For example, a duty cycle of the control valve of the intake camshaft phaser 195 may be modulated by the controller 12 in order to advance and/or retard the phase of the intake camshaft 193 in response to engine operating conditions (e.g., in response to a determined and/or predicted induction ratio of the engine). Similarly, the controller may advance and/or retard the phase of the exhaust camshaft 194 by transmitting electrical signals to the control valve of the exhaust camshaft phaser 196. Further examples of controlling (e.g., adjusting) the phase of the camshafts via the controller are described below.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature.

With regard to deactivation of one or more cylinders of the engine via the controller (e.g., adjusting one or more intake valves and/or exhaust valves to a deactivated mode via the controller in order to reduce a number of engine cylinders in which combustion occurs for a duration, as described above), deactivation of the one or more cylinders may affect operation of the intake camshaft phaser 195 and/or exhaust camshaft phaser 196. For example, although valve deactivation is often performed in order to increase engine efficiency (e.g., reduce an amount of fuel consumed by the engine at lower engine speeds, such as idle), adjusting engine operation via valve deactivation also affects the amount of torque on the camshafts of the engine resulting from intake and/or exhaust valve opening and closing events (as described above). Torque pulses are produced by the interaction between the intake and/or exhaust valves and the respective camshafts during valve opening/closing events. The torque pulses cumulatively result in a torque signature for each camshaft that is dependent on the number of engine cylinders associated with each camshaft, the relative configuration of the cylinder banks of the engine (e.g., the number of cylinders in each cylinder bank of the engine and/or the angle between opposing cylinder banks), and the configuration of the intake cams and exhaust cams (e.g., cam lobe shape, number of camshafts, etc.).

Operation of the camshaft phasers is affected by the variety of possible torque signatures. For example, during conditions in which fewer cylinders are deactivated (e.g., at higher engine speeds and/or higher engine torque demand), a greater amount of torque may be applied to the camshafts of the engine by the interactions of the intake/exhaust valves with the respective cams of the camshafts due to the increased number of intake valve and exhaust valve events occurring during engine operation (e.g., in order to combust fuel/air within the activated cylinders). In another example, during conditions in which a greater amount of cylinders are deactivated (e.g., at lower engine speeds and/or lower engine torque demand), a lower amount of torque may be applied to the camshafts of the engine by the interactions of the intake/exhaust valves with the respective cams of the camshafts due to the reduced number of intake valve and exhaust valve events occurring during engine operation. During conditions in which the amount of torque applied to the camshafts due to the intake/exhaust valve events is increased (e.g., during conditions in which all of the cylinders of the engine are activated), operation of the camshaft phasers may differ relative to conditions in which the amount of torque applied to the camshafts due to the intake/exhaust valve events is decreased (e.g., during conditions in which one or more of cylinders is deactivated).

In order to compensate for the varying operation (e.g., varying behavior) of the camshaft phasers for different engine induction ratios (e.g., different ratios of the number of activated cylinders relative to the number of deactivated cylinders), the controller may adjust each camshaft phaser differently relative to each other camshaft phaser based on the various engine induction ratios, as described below. By controlling (e.g., adjusting) operation (e.g., phase and/or phase rate) of the camshaft phasers based on the engine induction ratio, the cam torque actuated camshaft phasers may be operated more consistently for wider variety of engine operating conditions and may provide an increased phase rate and a reduced actuator power consumption relative to camshaft phasers that are not cam torque actuated camshaft phasers (e.g., electrically actuated camshaft phasers or oil pressure actuated camshaft phasers).

Figure 2:
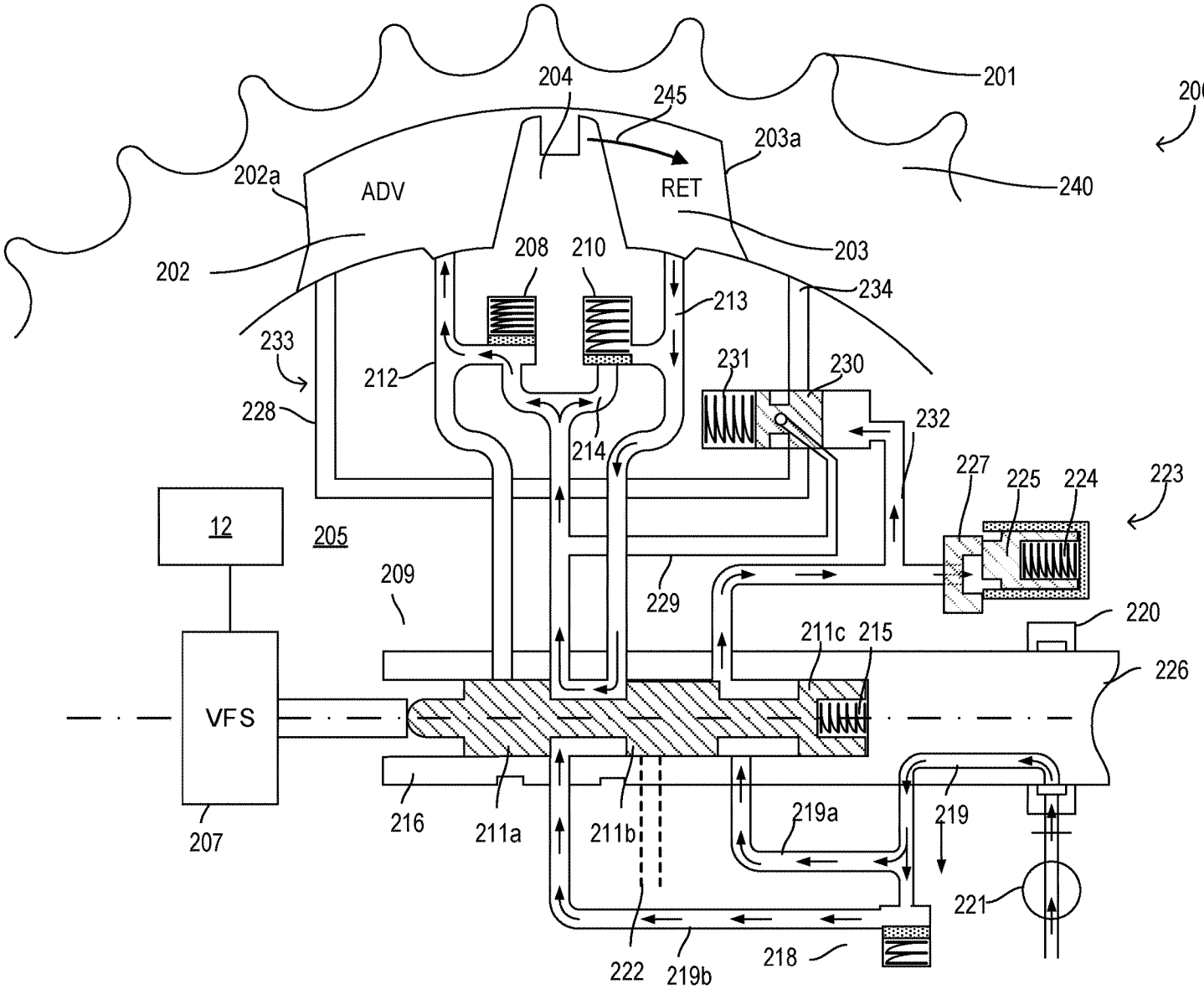
FIG. 2 schematically shows a cam torque actuated camshaft phaser of an engine.

Turning now to FIG. 2, example cam torque actuated camshaft phaser 200 is schematically shown. In one example, the camshaft phaser 200 may be similar to the intake camshaft phaser 195 and/or exhaust camshaft phaser 196 shown by FIG. 1 and described above. Actuation of the camshaft phaser 200 is enabled via cam torque pulses. Torque reversals in the camshaft, caused by the forces of opening and closing engine valves, may move a vane 204 disposed within the camshaft phaser 200. The camshaft phaser 200 further includes advance and retard chambers (e.g., advance chamber 202 and retard chamber 203) arranged to resist positive and negative torque pulses in the camshaft 226, with the advance and retard chambers being alternately pressurized by the cam torque. In some examples, camshaft 226 may be similar to intake camshaft 193 and/or exhaust camshaft 194 shown by FIG. 1 and described above. The camshaft phaser 200 includes a spool valve 209 (which may be referred to herein as a control valve) that enables the vane 204 in the camshaft phaser 200 to move by permitting fluid flow from the advance chamber 202 to the retard chamber 203 or vice versa, depending on the desired direction of movement. For example, when the desired direction of movement is in the advance direction, the spool valve 209 enables the vane 204 to move by permitting fluid flow from the retard chamber 203 to the advance chamber 202. In comparison, when the desired direction of movement is in the retard direction (e.g., opposite to the advance direction), the spool valve 209 enables the vane 204 to move by permitting fluid flow from the advance chamber 202 to the retard chamber 203.

FIG. 2 shows the camshaft phaser 200 in an advanced position, and spool valve 209 is shown positioned in an advance region of the spool as a non-limiting example. It will be appreciated that the spool valve 209 may have an infinite number of intermediate positions, such as positions in an advance region, null region, and detent region of the spool (as elaborated below). The position of the spool valve may not only control a direction of the motion of the camshaft phaser 200 but, depending on the discrete spool position, may also control the rate of the motion of the camshaft phaser 200.

Internal combustion engines (e.g., engine 10 shown by FIG. 1 and described above) have employed various mechanisms to vary the angle between the camshaft and the crankshaft for increased engine performance or reduced emissions. Often, variable camshaft timing (VCT) mechanisms use one or more "vane phasers" on the camshafts of the engine, such as the camshaft phaser 200. Camshaft phaser 200 may include a rotor 205 (which may be referred to herein as a rotor assembly) with one or more vanes (e.g., vane 204), with the rotor 205 mounted to the end of camshaft 226 and surrounded by a housing assembly 240, and with the housing assembly 240 including vane chambers with the vanes disposed therein. In an alternate example, vanes 204 may be mounted to the housing assembly 240, and the chambers may be mounted in the rotor assembly 205. The housing's outer circumference 201 forms the sprocket, pulley or gear accepting drive force through a chain, belt, or gears, usually from the crankshaft, or from another camshaft in a multiple-cam engine.

The housing assembly 240 of camshaft phaser 200 has an outer circumference 201 for accepting drive force. The rotor assembly 205 is connected to the camshaft 226 and is coaxially located within the housing assembly 240. The vane 204 is capable of rotation to shift the relative angular position of the housing assembly 240 and the rotor assembly 205. Additionally, a hydraulic detent circuit 233 and a locking pin circuit 223 are also present. The hydraulic detent circuit 233 and the locking pin circuit 223 are fluidly coupled making them essentially one fluid circuit, but will be discussed separately for simplicity and for better distinguishing their distinct functions. The hydraulic detent circuit 233 may include a biasing member 231 (e.g., a spring) biasing a piloted valve 230, an advance detent line 228 that connects the advance chamber 202 to the piloted valve 230 and a common line 214, and a retard detent line 234 that connects the retard chamber 203 to the piloted valve 230 and the common line 214. The advance detent line 228 and the retard detent line 234 may be a predetermined distance or length from the vane 204. The piloted valve 230 is in the rotor assembly 205 and is fluidly connected to the locking pin circuit 223 and supply line 319*a* through connecting line 232. The locking pin circuit 223 includes a locking pin 225, connecting line 232, the piloted valve 230, supply line 319*a*, and exhaust line 222 (dashed lines).

The piloted valve may be actuated between two positions, a first position which may correspond to a closed or off position, and a second position which may correspond to an open or on position. The piloted valve may be commanded to these positions by the spool valve. In the first position, the piloted valve is pressurized by engine generated oil pressure in line 232, which positions the piloted valve such that fluid is blocked from flowing between the advance retard chambers through the piloted valve and the detent circuit 233. In the second position, engine generated oil pressure in line 232 is absent. The absence of pressure in line 232 enables biasing member 231 to position the piloted valve so that fluid is allowed to flow between the detent line from the advance chamber and the detent line from the retard chamber through the piloted valve and a common line, such that the rotor assembly is moved to and held in the locking position.

The locking pin 225 is slidably housed in a bore in the rotor assembly 205 and has an end portion that is biased towards and fits into a recess 227 in the housing assembly 240 by a spring 224. Alternatively, the locking pin 225 may be housed in the housing assembly 240 and may be spring 224 biased towards a recess 227 in the rotor assembly 205. The opening and closing of the hydraulic detent circuit 233 and pressurization of the locking pin circuit 223 are both controlled by the switching/movement of spool valve 209.

Spool valve 209 includes a spool 211 with cylindrical lands 211*a*, 211*b*, and 211*c* slidably received in a sleeve 216 within a bore in the rotor 205 and pilots in the camshaft 226. One end of the spool contacts spring 215 and the opposite end of the spool contacts a pulse width modulated variable force solenoid (VFS) 207. The solenoid 207 may also be linearly controlled by varying duty cycle, current, voltage or other methods as applicable. Additionally, the opposite end of the spool 211 may contact and be influenced by a motor, or other actuators.

The position of the spool 211 is influenced by spring 215 and the solenoid 207 controlled by controller 12. Further detail regarding control of the phaser is discussed below. The position of the spool 211 controls the motion of the phaser, including a direction of motion as well as a rate of motion. For example, the position of the spool determines whether to move the phaser towards the advance position, towards a holding position, or towards the retard position. In addition, the position of the spool determines whether the locking pin circuit 223 and the hydraulic detent circuit 233 are open (on) or closed (off). In other words, the position of the spool 211 actively controls piloted valve 230. The spool valve 209 has an advance mode, a retard mode, a null mode, and a detent mode. These modes of control may be directly associated with regions of positioning. Thus, particular regions of the spool valve's stroke may allow the spool valve to operate in the advance, retard, null and detent modes.

In the advance mode, the spool 211 is moved to a position in the advance region of the spool valve, thereby enabling fluid to flow from the retard chamber 203 through the spool 211 on to the advance chamber 202, while fluid is blocked from exiting the advance chamber 202. In addition, the detent circuit 233 is held off or closed. In the retard mode, the spool 211 is moved to a position in the retard region of the spool valve, thereby enabling fluid to flow from the advance chamber 202 through the spool 211 on to the retard chamber 203, while fluid is blocked from exiting the retard chamber 203. In addition, the detent circuit 233 is held off or closed. In the null mode, the spool 211 is moved to a position in the null region of the spool valve, thereby blocking the exit of fluid from each of the advance and retard chambers 202, 203, while continuing to hold the detent circuit 233 off or closed. In the detent mode, the spool is moved to a position in the detent region. In the detent mode, three functions occur simultaneously. The first function in the detent mode is that the spool 211 moves to a position in which spool land 211*b* blocks the flow of fluid from line 212 in between spool lands 211*a* and 211*b* from entering any of the other lines and line 213, effectively removing control of the phaser from the spool valve 209. The second function in detent mode is the opening or turn on of the detent circuit 233. As such, the detent circuit 233 has complete control over the phaser moving to advance or retard positions, until the vane 204 reaches an intermediate phase angle position.

The third function in the detent mode is to vent the locking pin circuit 223, allowing the locking pin 225 to engage in the recess 227. The intermediate phase angle position, herein also referred to as the mid-lock position and also as the locking position, is defined as a position when the vane 204 is between advance wall 202*a* and retard wall 203*a*, the walls defining the chamber between the housing assembly 240 and the rotor assembly 205. The locking position may be a position anywhere between the advance wall 202*a* and retard wall 203*a* and is determined by a position of detent passages 228 and 234 relative to the vane 204. Specifically, the position of detent passages 228 and 234 relative to the vane 204 define a position wherein neither passage may be exposed to advance and retard chambers 202 and 203, thus fully disabling communication between the two chambers when the piloted valve is in the second position and the phasing circuit is disabled. Commanding the spool valve to the detent region may also be referred to herein as commanding a "hard lock" or "hard locking" the camshaft phaser, in reference to the hardware component (locking pin) involved in locking the camshaft phaser being engaged at the mid-lock position.

Based on the duty cycle of the pulse width modulated variable force solenoid 207, the spool 211 moves to a corresponding position along its stroke. In one example, when the duty cycle of the variable force solenoid 207 is approximately 30%, 50% or 100%, the spool 211 may be moved to positions that correspond with the retard mode, the null mode, and the advance mode, respectively, and the piloted valve 230 is pressurized and moved from the second position to the first position, while the hydraulic detent circuit 233 is closed, and the locking pin 225 is pressurized and released.

As another example, when the duty cycle of the variable force solenoid 207 is set to 0%, the spool 211 may be moved to the detent mode such that the piloted valve 230 vents and moves to the second position, the hydraulic detent circuit 233 is opened, and the locking pin 225 is vented and engaged with the recess 227. By choosing a duty cycle of 0% as the extreme position along the spool stroke to open the hydraulic detent circuit 233, vent the piloted valve 230, and vent and engage the locking pin 225 with the recess 227, in the event that power or control is lost, the phaser may default to a locked position, improving camshaft phaser position certainty. It should be noted that the duty cycle percentages listed above are provided as non-limiting examples, and in alternate embodiments, different duty cycles may be used to move the spool of the spool valve between the different spool regions. For example, the hydraulic detent circuit 233 may alternatively be opened, the piloted valve 230 vented, and the locking pin 225 vented and engaged with the recess 227 at 100% duty cycle. In this example, the detent region of the spool valve may be adjacent to the advance region instead of the retard region. In another example, the detent mode may be at a 0% duty cycle, and duty cycles of approximately 30%, 50%, and 100% may move spool 211 to positions that correspond with the advance mode, the null mode, and the retard mode. Likewise in this example, the advance region of the spool valve is adjacent to the detent region.

In some examples, such as the examples described further below with reference to FIGS. 6-10, the controller adjusts the duty cycle based on an induction ratio of the engine in order to enable a more consistent operation of the camshaft phasers during conditions in which one or more of the cylinders of the engine is deactivated. During selected conditions, a controller may map one or more regions of the spool by varying the duty cycle commanded to the spool valve and correlating it with corresponding changes in phaser position.

In some examples, in order to move the phaser towards the advance position, the duty cycle of the spool valve is increased to greater than 50%, and optionally up to 100%. As a result, the force of the solenoid 207 on the spool 211 is increased, and the spool 211 is moved to the right, towards an advance region and operated in an advance mode, until the force of the spring 215 balances the force of the solenoid 207. In the advance mode shown, spool land 211*a* blocks line 212 while lines 213 and 214 are open. In this scenario, camshaft torque pulses resulting from interactions between cams of the camshaft 226 with their driven intake or exhaust valves pressurize the retard chamber 203, causing fluid to move from the retard chamber 203 into advance chamber 202, thereby moving vane 204 in the direction shown by arrow 245. Hydraulic fluid exits from the retard chamber 203 through line 213 to the spool valve 209, between spool lands 211*a* and 211*b* and recirculates back to central line 214 and line 212 leading to the advance chamber 202.

The piloted valve is held in the first position, blocking detent lines 228 and 234.

In an alternate example, in order to move the phaser towards the retard position, the duty cycle of the spool valve may be decreased to lower than 50%, and optionally up to 30%. As a result, the force of the solenoid 207 on the spool 211 is decreased, and the spool 211 is moved to the left, towards a retard region and operated in a retard mode, until the force of the spring 215 balances the force of the solenoid 207. In the retard mode, spool land 211*b* blocks line 213 while lines 212 and 214 are open. In this scenario, camshaft torque pulses pressurize the advance chamber 202, causing fluid to move from the advance chamber 202 into retard chamber 203, and thereby moving vane 204 in a direction opposite to that shown by arrow 245. Hydraulic fluid exits from the advance chamber 202 through line 212 to the spool valve 209, between spool lands 211*a* and 211*b* and recirculates back to central line 214 and line 213 leading to the retard chamber 203. The piloted valve is held in the first position, blocking detent lines 228 and 234.

In a further example, to move the phaser to, and lock in, the intermediate phase angle (or mid-lock) position, the duty cycle of the spool valve is decreased to 0%. As a result, the force of the solenoid 207 on the spool 211 is decreased, and the spool 211 is moved to the left, towards a detent region and operated in a detent mode, until the force of the spring 215 balances the force of the solenoid 207. In the detent mode, spool land 211*b* blocks lines 212, 213, and 214, and spool land 211*c* blocks line 319*a* from pressurizing line 232 to move the piloted valve to the second position. In this scenario, camshaft torque pulses do not provide actuation. Instead, hydraulic fluid exits from the advance chamber 202 through detent line 228 to the piloted valve 230, through the common line 229 and recirculates back to central line 214 and line 213 leading to the retard chamber 203.

Figure 3A:
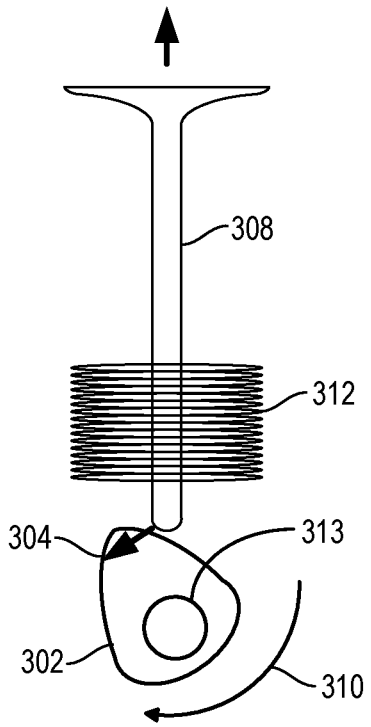
FIGS. 3A-3B schematically depict an effect of camshaft torsional pulses on a cam torque actuated camshaft phaser.
Figure 3B:
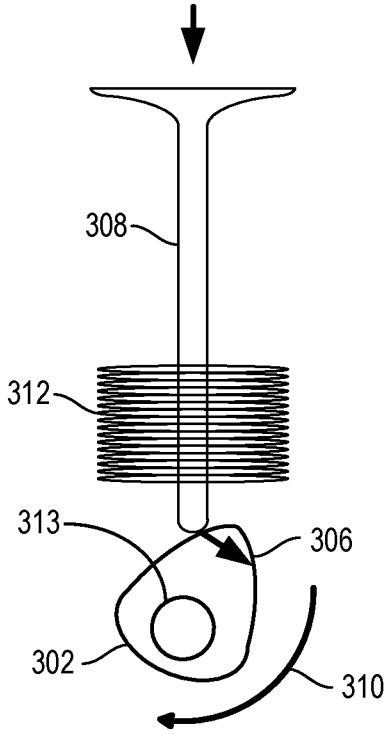

FIGS. 3A-3B schematically shows the effect of cam torsionals. Specifically, FIGS. 3A-3B depict a single-lobe cam 1002 in two different states. FIG. 3A shows cam 302 coupled to camshaft 313 (e.g., similar to camshaft 226 shown by FIG. 2, intake camshaft 193, and/or exhaust camshaft 194 shown by FIG. 1 and described above) subjected to retarded cam torsion 304, and FIG. 3B shows cam 302 subjected to advanced cam torsion 306. As shown by FIG. 3A, the clockwise rotational motion 310 of cam 302 pushes valve 308 upward, and retarded cam torsion 304 is imparted onto the cam by the resisting force of biasing member 312 (e.g., a spring). As shown by FIG. 3B, after the angular position of cam 302 passes the point of maximum spring compression, biasing member spring 312 imparts advanced cam torsion 306 upon the cam as the biasing member decompresses and valve 308 moves downward. The torsion applied to cam 1002 may be transferred to the camshaft 313 which may have an effect on the operation of a camshaft phaser (e.g., camshaft phaser 200) of the camshaft 313, as described above with reference to FIG. 2.

FIGS. 3A-3B schematically show the interaction of cam 1002 with valve 308 (e.g., with the biasing member 312 of valve 308). However, as described above, the engine (e.g., engine 10) may include a plurality of cams similar to cam 1002, and a plurality of valves similar to valve 308 (e.g., intake valve 150 and exhaust valve 156). Each cam may interact with a corresponding valve of the plurality of valves in a similar way as described above with reference to cam 1002 and valve 308. As a result, a total torque applied to the camshaft 313 due to the interactions of the cams of the camshaft 313 with the valves depends on a number of activated cylinders having valves driven by the cams of the camshaft 313. For example, during conditions in which one or more cylinders is deactivated, the total torque applied to the camshaft 313 may be less than a total torque applied to the camshaft 313 during conditions in which all of the cylinders are activated. A phase rate of the camshaft phaser (e.g., a rate at which the camshaft phaser adjusts a phase of the camshaft 313 relative to a crankshaft of the engine) may be reduced during conditions in which the total torque applied to the camshaft 313 is decreased (e.g., when the one or more cylinders are deactivated). As a result, the controller of the engine (e.g., controller 12 shown by FIG. 1 and described above) may adjust operation of the camshaft phaser in order to compensate for the decreased phase rate, as described below with reference to FIGS. 6-10.

Although the cam 302 is shown by FIGS. 3A-3B directly contacting the valve 308, in some examples, one or more other components may be positioned between the cam 302 and valve 308 in order to transmit impulses from the cam 302 to the valve 308, and vice versa. For example, a rocker arm may be positioned between cam 302 and valve 308, and may convert the rotational motion of the cam 302 into linear motion of the valve 308 during conditions in which the nose of the cam engages with the rocker arm in order to pivot the rocker arm.

FIG. 4 shows a graph 401 illustrating an ignition timing and combustion cycle of an engine including six cylinders, with each cylinder in an activated mode. In one example, the engine may be similar to engine 10 shown by FIG. 1 and described above, and the cylinders of the engine may be similar to the cylinder 14 described above. The cylinders of the engine may be disposed within two different cylinder banks (e.g., a first cylinder bank and a second cylinder bank), with the first cylinder bank including a first grouping of three cylinders in an inline arrangement (e.g., positioned along a same, first axis) and the second cylinder bank including a second grouping of three cylinders in an inline arrangement (e.g., positioned along a same, second axis parallel to the first axis). Specifically, cylinder 1, cylinder 2, and cylinder 3 indicated by FIG. 4 may be disposed within the first cylinder bank, and cylinder 4, cylinder 5, and cylinder 6 indicated by FIG. 4 may be disposed within the second cylinder bank, with the first cylinder bank being positioned opposite to the second cylinder bank across a central axis of the engine.

In the configuration described above, the firing order may be 1-4-2-5-3-6, with cylinders 1, 2, and 3 residing in one grouping (e.g., the first grouping), and with cylinders 4, 5, and 6 residing in the other grouping (e.g., the second grouping). For every 720 degrees of crankshaft rotation, each of the cylinders 1 through 6 may be fired once, with each firing event (e.g., combustion event) occurring when the crankshaft has rotated approximately 120 degrees since the most recent previous firing event, as illustrated at 400. For example, cylinder 4 may fire after cylinder 1, with approximately 120 degrees of crankshaft rotation occurring therebetween. Similarly, cylinder 2 may fire after cylinder 4, with approximately 120 degrees of crankshaft rotation occurring therebetween.

In the example shown by FIG. 4, each cylinder includes one intake valve and one exhaust valve. However, in other examples, one or more of the cylinders may include a different number of intake valves and/or exhaust valves (e.g., two intake valves and two exhaust valves eaxh). Opening and closing of the intake valve of each cylinder is indicated in solid lines. For example, movement of the intake valve of cylinder 1 is indicated by plot 404, movement of the intake valve of cylinder 2 is indicated by plot 412, movement of the intake valve of cylinder 3 is indicated by plot 420, movement of the intake valve of cylinder 4 is indicated by plot 428, movement of the intake valve of cylinder 5 is indicated by plot 436, and movement of the intake valve of cylinder 6 is indicated by plot 444. Opening and closing of the exhaust valve of each cylinder is indicated by a first set of dashed lines. For example, movement of the exhaust valve of cylinder 1 is indicated by plot 402, movement of the exhaust valve of cylinder 2 is indicated by plot 410, movement of the exhaust valve of cylinder 3 is indicated by plot 418, movement of the exhaust valve of cylinder 4 is indicated by plot 426, movement of the exhaust valve of cylinder 5 is indicated by plot 434, and movement of the exhaust valve of cylinder 6 is indicated by plot 442.

Combustion events (e.g., firing) of each cylinder is indicated by a star symbol. For example, combustion events of cylinder 1 are indicated by symbols 406, combustion events of cylinder 2 are indicated by symbols 414, combustion events of cylinder 3 are indicated by symbols 422, combustion events of cylinder 4 are indicated by symbols 430, combustion events of cylinder 5 are indicated by symbols 438, and combustion events of cylinder 6 are indicated by symbols 446. Fuel injection of each cylinder is indicated by a second set of dashed lines. For example, fuel injection in cylinder 1 is indicated by plot 408, fuel injection in cylinder 2 is indicated by plot 416, fuel injection in cylinder 3 is indicated by plot 424, fuel injection in cylinder 4 is indicated by plot 432, fuel injection in cylinder 5 is indicated by plot 440, and fuel injection in cylinder 6 is indicated by plot 448.

An electronic controller of the engine (e.g., controller 12 described above with reference to FIG. 1) may advance and/or retard an opening and closing timing of intake valves and/or exhaust valves of one or more of the cylinder banks. In one example, the controller may advance an opening and closing timing of intake valves and exhaust valves of the first cylinder bank by adjusting operation of camshaft phasers of the first cylinder bank (e.g., intake camshaft phaser 195 and exhaust camshaft phaser 196 described above with reference to FIG. 1, and/or camshaft phaser 200 described above with reference to FIG. 2). The intake valves of each cylinder of the first cylinder bank may be driven by cams of a first intake camshaft having a first camshaft phaser, and the exhaust valves of each cylinder of the first cylinder bank may be driven by cams of a first exhaust camshaft having a second camshaft phaser. The controller may transmit electrical signals (e.g., pulse width modulated actuating signals or control signals) to a respective control valve actuator of each of the first camshaft phaser and second camshaft phaser (e.g., modulated variable force solenoid 207 described above with reference to FIG. 2) in order to adjust a duty cycle of the actuator. Specifically, the first camshaft phaser may include a first control valve having a first control valve actuator, and the second camshaft phaser may include a second control valve having a second control valve actuator. The duty cycle of each of the first control valve actuator and second control valve actuator may be adjusted by the controller in order to flow hydraulic fluid to an advance chamber of each, with the duty cycle of the actuator resulting in a positive flow of hydraulic fluid to an advance chamber of the phasers, as described above.

FIG. 5 shows a graph 501 illustrating an ignition timing and combustion cycle of the engine described above with reference to FIG. 4, with the engine operating at various induction ratios via deactivation of one or more cylinders. In the example shown by FIG. 5, the engine is operating in a rolling variable displacement mode, wherein the controller of the engine (e.g., controller 12 shown by FIG. 1 and described above) continually monitors engine operating conditions and adjusts the induction ratio of the engine based on the engine operating conditions. For example, the controller may monitor a torque demand of the engine (e.g., a commanded torque output of the engine according to a pedal position, such as a position of input device 132 shown by FIG. 1 and described above), and may adjust the engine induction ratio based on the torque demand (e.g., by activating and/or deactivating one or more intake valves and/or exhaust valves as described above).

In one example, the controller may increase the induction ratio in response to increased torque demand (e.g., increase a number of activated cylinders of the engine), and may decrease the induction ratio in response to decreased torque demand (e.g., decrease the number of activated cylinders). Additionally, the particular cylinders that are activated and/or deactivated by the controller may be selected in order to reduce a noise, vibration, and/or harshness of the engine during operation. For example, the controller may deactivate one or more cylinders of the first cylinder bank during a first complete combustion cycle of the engine, and may deactivate one or more cylinders of the second cylinder bank during a second complete combustion cycle of the engine immediately following the first cycle. Further examples are described below.

Prior to time t0 (e.g., during first duration 502), the engine operates with each cylinder activated (e.g., fuel and air are combusted within each cylinder of the engine). As such, during the first duration 502, the engine induction ratio is 1 (e.g., the ratio of activated cylinders to total number of cylinders is 1, because all of the cylinders are activated).

Between time t0 and t1 (e.g., during second duration 504), the controller deactivates the intake valves and exhaust valves of cylinder 4 following combustion of fuel/air within cylinder 4, deactivates the intake valves and exhaust valves of cylinder 5 following combustion of fuel/air within cylinder 5, and deactivates the intake valves and exhaust valves of cylinder 6 following combustion of fuel/air within cylinder 6. However, combustion occurs in each cylinder between time t0 and t1, and so the engine induction ratio for the second duration is 1.

Between time t1 and t2 (e.g., during third duration 506), the intake valves and exhaust valves of cylinder 4, cylinder 5, and cylinder 6 are still deactivated. Further, combustion does not occur in cylinder 4, cylinder 5, and cylinder 6 (e.g., fuel is not injected, and spark does not occur). As a result, for the third duration 506, the engine induction ratio is 0.5.

Between time t2 and t3 (e.g., during fourth duration 508), the intake valves and exhaust valves of cylinder 4 are activated by the controller, while the intake valves and exhaust valves of cylinder 5 and cylinder 6 remain deactivated. Further, following combustion in cylinder 2, the intake valves and exhaust valves of cylinder 2 are deactivated. As a result, for the fourth duration 508, combustion occurs only in cylinder 1, cylinder 2, and cylinder 3, so the engine induction ratio is 0.5.

Between time t3 and t4 (e.g., during fifth duration 510), the intake valves and exhaust valves of cylinder 2, cylinder 5, and cylinder 6 are activated by the controller. For the fifth duration 510, combustion of fuel/air occurs in cylinder 1, cylinder 3, cylinder 4, and cylinder 6. As a result, the engine induction ratio throughout fifth duration 510 is 4/6 (e.g., approximately 0.66).

Between time t4 and t5 (e.g., during sixth duration 512), the intake valves and exhaust valves of cylinder 2 are deactivated following combustion of fuel/air within cylinder 2, the intake valves and exhaust valves of cylinder 3 are deactivated following combustion of fuel/air within cylinder 3, and the intake valves and exhaust valves of cylinder 4 are deactivated following combustion of fuel/air within cylinder 4. However, combustion of fuel/air occurs in each cylinder for the sixth duration 512, and as a result, the engine induction ratio is 1.

Between time t5 and t6 (e.g., during seventh duration 514), the intake valves and exhaust valves of cylinder 1 are deactivated following combustion of fuel/air within cylinder 1, the intake valves and exhaust valves of cylinder 5 are deactivated following combustion of fuel/air within cylinder 5, and the intake valves and exhaust valves of cylinder 6 are deactivated following combustion of fuel/air within cylinder 6. Further, the intake valves and exhaust valves of cylinder 2 are activated, the intake valves and exhaust valves of cylinder 3 remain deactivated, and the intake valves and exhaust valves of cylinder 4 are activated. Throughout the seventh duration 514, combustion of fuel/air occurs only in cylinder 1, cylinder 5, and cylinder 6. As a result, the engine induction ratio for seventh duration 514 is 0.5.

Between time t6 and t7 (e.g., during eighth duration 516), the intake valves and exhaust valves of cylinder 1 are activated by the controller, the intake valves and exhaust valves of cylinder 5 are activated, the intake valves and exhaust valves of cylinder 2 remain activated, the intake valves and exhaust valves of cylinder 4 remain activated, the intake valves and exhaust valves of cylinder 3 remain deactivated, and the intake valves and exhaust valves of cylinder 6 remain deactivated. Throughout eighth duration 516, combustion of fuel/air occurs only in cylinder 2 and cylinder 4. As a result, the engine induction ratio for eighth duration 516 is 2/6 (e.g., approximately 0.33).

Following time t7 (e.g., during ninth duration 518), the intake valves and exhaust valves of cylinder 6 remain deactivated, and the intake valves and exhaust valves of each other cylinder remain activated. Combustion of fuel/air occurs only in cylinder 1, cylinder 2, cylinder 3, cylinder 4, and cylinder 5, so the engine induction ratio during the ninth duration 518 is 5/6 (e.g., approximately 0.83).

With regard to the durations described above, first duration 502 may correspond to 720 degrees of crankshaft rotation, second duration 504 may correspond to 720 degrees of crankshaft rotation immediately following first duration 502, third duration 506 may correspond to 720 degrees of crankshaft rotation immediately following second duration 504, fourth duration 508 may correspond to 720 degrees of crankshaft rotation immediately following third duration 506, fifth duration 510 may correspond to 720 degrees of crankshaft rotation immediately following fourth duration 508, sixth duration 512 may correspond to 720 degrees of crankshaft rotation immediately following fifth duration 510, seventh duration 514 may correspond to 720 degrees of crankshaft rotation immediately following sixth duration 512, eighth duration 516 may correspond to 720 degrees of crankshaft rotation immediately following seventh duration 514, and ninth duration 518 may correspond to 720 degrees of crankshaft rotation immediately following eighth duration 516. As referred to herein, a duration immediately following another duration indicates that no other durations occur therebetween. For example, third duration 506 immediately follows second duration 504, with no rotation of the crankshaft occurring between the second duration 504 and third duration 506.

By operating the engine in the rolling variable displacement mode, an efficiency of the engine may be increased. For example, during lower engine speeds and/or lower engine torque demand, the controller may deactivate one or more cylinders of the engine (as indicated by fifth duration 510, in one example) to reduce a fuel consumption of the engine and/or reduce engine pumping losses.

Additionally, the controller may activate and/or deactivate particular engine cylinders in order to reduce a noise, vibration, and/or harshness of the engine at a variety of engine speeds. However, due to the large variety of possible activated cylinder configurations and deactivated cylinder configurations in the rolling variable displacement mode, phase rates of camshaft phasers of the engine may be decreased. Additionally, torque applied to camshafts due to interactions of cams of the camshafts with their corresponding intake/exhaust valves may be different for camshafts of the first cylinder bank relative to camshafts of the second cylinder bank, depending on which cylinders are activated and which cylinders are deactivated. For example, during seventh duration 514 described above, less torque may be applied to camshafts of the first cylinder bank due to the decreased number of activated cylinders of the first cylinder bank relative to the second cylinder bank, and more torque may be applied to camshafts of the second cylinder bank due to the increased number of activated cylinders of the second cylinder bank.

In order to compensate for the above issues and increase engine performance, the controller adjusts operation of the camshaft phasers of each cylinder bank independently, as described below. In some examples, the controller may perform a first adjustment to camshaft phasers of the first cylinder bank, and may perform a different, second adjustment to camshaft phasers of the second cylinder bank.

FIG. 6 shows a first graph 600 illustrating a phase rate of a first camshaft phaser of a first cylinder bank of an engine with respect to adjustments to a duty cycle of a control valve of the first camshaft phaser, and additionally shows a second graph 602 illustrating a phase rate of a second camshaft phaser of a second cylinder bank of the engine with respect to adjustments to a duty cycle of a control valve of the second camshaft phaser. In one example, the engine may be similar to engine 10 shown by FIG. 1 and described above, the camshaft phasers are cam torque actuated camshaft phasers that may be similar to the camshaft phasers described above with reference to FIGS. 1-3 (e.g., intake camshaft phaser 195, exhaust camshaft phaser 196, and/or camshaft phaser 200), and the control valves may be similar to the phaser control valves of the cam torque actuated camshaft phasers described above with reference to FIGS. 1-3 (e.g., spool valve 209). The phase rates indicated by first graph 600 and second graph 602 are unadjusted phase rates. Specifically, although the various plots of the first graph 600 and second graph 602 are shown to indicate the relationship between phase rate and adjustments to duty cycle for different engine induction ratios, the phase rates have not been adjusted based on the engine induction ratios in FIG. 6.

First graph 600 includes four plots (e.g., first plot 604, second plot 606, third plot 608, and fourth plot 610), with each of the plots illustrating the phase rate of the first camshaft phaser of the first cylinder bank of the engine with respect to adjustments to the duty cycle of the control valve of the first camshaft phaser for different engine induction ratios. Specifically, first plot 604 illustrates the above relationship of phase rate versus change in duty cycle at an engine induction ratio of 0.25, second plot 606 illustrates phase rate versus change in duty cycle at an engine induction ratio of 0.50, third plot 608 illustrates phase rate versus change in duty cycle at an engine induction ratio of 0.75, and fourth plot 610 illustrates phase rate versus change in duty cycle at an engine induction ratio of 1.00.

Second graph 602 includes four plots (e.g., fifth plot 612, sixth plot 614, seventh plot 616, and eighth plot 618), with each of the plots illustrating the phase rate of the second camshaft phaser of the second cylinder bank of the engine with respect to adjustments to the duty cycle of the control valve of the second camshaft phaser for different engine induction ratios. Specifically, fifth plot 612 illustrates the above relationship of phase rate versus change in duty cycle at an engine induction ratio of 0.25, sixth plot 614 illustrates phase rate versus change in duty cycle at an engine induction ratio of 0.50, seventh plot 616 illustrates phase rate versus change in duty cycle at an engine induction ratio of 0.75, and eighth plot 618 illustrates phase rate versus change in duty cycle at an engine induction ratio of 1.00.

It should be noted that although the engine induction ratios 0.25, 0.50, 0.75, and 1.00 are associated with the plots as described above, the engine may have different induction ratios. For example, the engine may be configured as a six cylinder engine with three cylinders in each cylinder bank (e.g., as described above with reference to FIGS. 4-5), and plots illustrating phase rate versus change in duty cycle for each cylinder bank of the engine may have a similar relationship relative to those shown by FIG. 6. In one example, the engine may have induction ratios of at least 2/6, 4/6, and 1 (among others), and the phase rate may vary more rapidly with changes in duty cycle during conditions in which the engine induction ratio is 1 relative to conditions in which the engine induction ratio is less than 1 (e.g., 4/6).

As illustrated by first graph 600, each of the first plot 604, second plot 606, third plot 608, and fourth plot 610 intersect with each other at the intersection of vertical axis 620 and horizontal axis 622. In one example, locations along vertical axis 620 may correspond to 0 change in duty cycle for control valves of camshaft phasers of the first cylinder bank, and locations along horizontal axis 622 may correspond to a phase rate of 0 for camshaft phasers of the first cylinder bank. Similarly, as illustrated by second graph 602, each of the fifth plot 612, sixth plot 614, seventh plot 616, and eighth plot 618 intersect with each other at the intersection of vertical axis 624 and horizontal axis 626. In one example, locations along vertical axis 624 may correspond to 0 change in duty cycle for control valves of camshaft phasers of the second cylinder bank, and locations along horizontal axis 626 may correspond to a phase rate of 0 for camshaft phasers of the second cylinder bank.

Although the first graph 600 and the second graph 602 appear similar, the curvature of each of the plots of the first graph 600 (e.g., first plot 604, second plot 606, third plot 608, and fourth plot 610) is different relative to the curvature of each of the plots of the second graph 602 (e.g., fifth plot 612, sixth plot 614, seventh plot 616, and eighth plot 618). For example, although fourth plot 610 of first graph 600 and eighth plot 618 of second graph 602 each indicate a phase rate versus change in duty cycle relationship for an engine induction ratio of 1, differences between configurations of the first cylinder bank and the second cylinder bank result in a different curvature of the fourth plot 610 relative to the eighth plot 618. In one example, the first cylinder bank and second cylinder bank may include different manufacturing tolerances, part-to-part variability (e.g., variation in components of the first cylinder bank relative to the second cylinder bank), differences in an oil supply system for each cylinder bank (e.g., a relative shape and/or arrangement of oil passages), etc. Such differences may result in different (unadjusted) performance of the camshaft phasers of the first cylinder bank and second cylinder bank.

FIG. 7 shows a first graph 700 and a second graph 702 indicating a relationship between engine induction ratio and phase rate ratio for the first cylinder bank and second cylinder bank, respectively, of the engine described above with reference to FIG. 6. Specifically, first graph 700 includes plot 704 and second graph 702 includes plot 706, with plot 704 indicating the phase rate ratio of the camshaft phasers of the first cylinder bank relative to the engine induction ratio, and with plot 706 indicating the phase rate ratio of the camshaft phasers of the second cylinder bank relative to the same engine induction ratio. The plots 704 and 706 may be referred to herein as adjustment curves.

Phase rate ratio, as described herein with reference to FIG. 7, is a ratio of camshaft phaser phase rate at a specified engine induction ratio (e.g., an induction ratio between 0 and 1) relative to a camshaft phaser phase rate at an engine induction ratio of 1. For example, locations along axis 710 of first graph 700 may correspond to an engine induction ratio of 1, and locations along axis 708 may correspond to a phase rate ratio of 1. Accordingly, the location positioned at the intersection of axis 710 and axis 708 may correspond to a location along plot 704 indicating an engine induction ratio of 1 and a phase rate ratio of 1. As the engine induction ratio decreases (e.g., at locations along the plot 704 to the left of the intersection of axis 708 and axis 710), the phase rate ratio also decreases. As one example, at a location 724 along the plot 704 corresponding to an intersection of axis 716 and axis 718, the engine induction ratio may be 0.25 and the phase rate ratio of the camshaft phasers of the first cylinder bank may be approximately 0.59. Said another way, at location 724 along plot 704, the phase rate of the camshaft phasers of the first cylinder bank may be 59% of the phase rate of the camshaft phasers of the first cylinder bank during conditions in which the engine induction ratio is 1 (e.g., at the intersection of axis 708 and 710), due to the engine induction ratio being 0.25 at location 724.

As another example, locations along axis 714 of second graph 702 may correspond to an engine induction ratio of 1, and locations along axis 712 may correspond to a phase rate ratio of 1 of camshaft phasers of the second cylinder bank. Accordingly, the location positioned at the intersection of axis 714 and axis 712 may correspond to a location along plot 706 indicating an engine induction ratio of 1 and a phase rate ratio of 1. As the engine induction ratio decreases (e.g., at locations along the plot 706 to the left of the intersection of axis 712 and axis 714), the phase rate ratio also decreases. As one example, at a location 726 along the plot 706 corresponding to an intersection of axis 720 and axis 722, the engine induction ratio may be 0.25 and the phase rate ratio of the camshaft phasers of the second cylinder bank may be approximately 0.52. Said another way, at location 726 along plot 706, the phase rate of the camshaft phasers of the second cylinder bank may be 52% of the phase rate of the camshaft phasers of the second cylinder bank during conditions in which the engine induction ratio is 1 (e.g., at the intersection of axis 712 and 714), due to the engine induction ratio being 0.25 at location 726.

As shown by FIG. 7, the curvature of the plot 704 differs from the curvature of the plot 706, indicating that the phase rate ratio of the camshaft phasers of the first cylinder bank varies with engine induction ratio in a different way than the phase rate ratio of the camshaft phasers of the second cylinder bank. In one example, the difference in curvature of the plot 704 relative to the plot 706 is a result of different manufacturing tolerances, part-to-part variability (e.g., variation in components of the first cylinder bank relative to the second cylinder bank), differences in an oil supply system for each cylinder bank (e.g., a relative shape and/or arrangement of oil passages), etc.

The plots 704 and 706 may be utilized by the controller of the engine (e.g., controller 12 shown by FIG. 1 and described above) in order to control (e.g., scale) the phase rates shown by FIG. 6. For example, the controller 12 may include functions or tables (e.g., adjustment curves) stored in non-transitory memory of the controller indicating the relationship between engine induction ratio to phase rate ratio for each cylinder bank of the engine, similar to the plots shown by FIG. 7. The controller may further utilize the functions or tables in order to scale the unadjusted phase rates of the camshaft phasers based on the engine induction ratio. For example, as shown by FIG. 6, a difference (indicated by arrow 628) between phase rates indicated by first plot 604 and fourth plot 610 is relatively large. Similarly, a difference (indicated by arrow 630) between phase rates indicated by fifth plot 612 and eighth plot 618 is relatively large. The controller may control (e.g., scale) the unadjusted phase rates shown by FIG. 6 based on the relationships between engine induction ratio and phase rate ratio shown by FIG. 7 in order to reduce the differences between the phase rates for different engine induction ratios. For example, the controller may scale the unadjusted phase rates shown by FIG. 6 based on the relationship between engine induction ratio and phase rate ratio (as shown by FIG. 7 and described above) in order to reduce the differences (e.g., as indicated by arrow 628 and arrow 630) between the various phase rates associated with each cylinder bank at different engine induction ratios. Examples of scaled phase rates are shown by FIG. 8 and described below.

FIG. 8 shows a first graph 800 and a second graph 802 illustrating scaled phase rates of the first cylinder bank and second cylinder bank, respectively, of the engine described above with reference to FIGS. 6-7. First graph 800 includes three plots (e.g., first plot 804, second plot 806, third plot 808), with each of the three plots illustrating the scaled phase rate of the first camshaft phaser of the first cylinder bank of the engine with respect to adjustments to the duty cycle of the control valve of the first camshaft phaser for different engine induction ratios. Additionally, first graph 800 includes fourth plot 610, as was described above with reference to FIG. 6, in order to show the scaled phase rates indicated by first plot 804, second plot 806, and third plot 808 relative to the phase rates associated with the engine induction ratio of 1. Specifically, first plot 804 illustrates the above relationship of scaled phase rate versus change in duty cycle at an engine induction ratio of 0.25, second plot 806 illustrates scaled phase rate versus change in duty cycle at an engine induction ratio of 0.50, third plot 808 illustrates scaled phase rate versus change in duty cycle at an engine induction ratio of 0.75, and fourth plot 610 illustrates phase rate versus change in duty cycle at the engine induction ratio of 1.

Second graph 802 includes four plots (e.g., fifth plot 812, sixth plot 814, seventh plot 816, and eighth plot 818), with each of the plots illustrating the scaled phase rate of the second camshaft phaser of the second cylinder bank of the engine with respect to adjustments to the duty cycle of the control valve of the second camshaft phaser for different engine induction ratios. Specifically, fifth plot 812 illustrates the above relationship of scaled phase rate versus change in duty cycle at an engine induction ratio of 0.25, sixth plot 814 illustrates phase rate versus change in duty cycle at an engine induction ratio of 0.50, seventh plot 816 illustrates phase rate versus change in duty cycle at an engine induction ratio of 0.75, and eighth plot 818 illustrates phase rate versus change in duty cycle at an engine induction ratio of 1.00.

As described above, the scaled phase rates shown by FIG. 8 are a result of scaling the unadjusted phase rates shown by FIG. 6 based on the engine induction ratio (e.g., the relationship between engine induction ratio and phase rate ratio shown by FIG. 7). For example, first plot 804 shown by FIG. 8 results from scaling the unadjusted phase rates indicated by first plot 604 shown by FIG. 6 based on the engine induction ratio, second plot 806 shown by FIG. 8 results from scaling the unadjusted phase rates indicated by second plot 606 shown by FIG. 6 based on the engine induction ratio, etc. Scaling the phase rates includes scaling a duty cycle of the control valves of the camshaft phasers of the first cylinder bank and second cylinder bank in relation to (e.g., based on) the engine induction ratio via a scaling factor. In some examples, the duty cycle of the control valves is scaled upward (e.g., increased) as the engine induction ratio decreases, and the duty cycle of the control valves is scaled downward (e.g., decreased) as the engine induction ratio increases.

For example, in order to scale the unadjusted phase rates indicated by first plot 604 of FIG. 6 to the scaled phase rates indicated by first plot 804 of FIG. 8, the controller may determine a duty cycle of the control valves of the camshaft phasers of the first cylinder bank based on functions or look-up tables stored in memory of the controller (e.g., according to the relationship between engine induction ratio and phase rate ratio shown by FIG. 7, as shown by first graph 700), with the duty cycle corresponding to the scaled phase rates scaled relative to the unadjusted phase rates by a first scaling factor. Specifically, because each of first plot 604 and first plot 804 indicate phase rates (e.g., unadjusted and scaled, respectively) of the camshaft phasers of the first cylinder bank at an engine induction ratio of 0.25, and because at location 724 along plot 704 shown by FIG. 7 the induction ratio is 0.25 and the phase rate ratio is approximately 0.59 in one example, the controller may determine the duty cycle of the control valves of the camshaft phasers of the first cylinder bank in order to scale the unadjusted phase rates by the first scaling factor (e.g., approximately 169% in this example) during conditions in which the engine induction ratio is 0.25 in order to enable the phase rates of the camshaft phasers of the first cylinder bank to be approximately the same as phase rates associated with the engine induction ratio of 1. However, during conditions in which the engine induction ratio is a different amount less than 1 (e.g., 0.50), the first scaling factor may be a different amount according to the plot 704 (e.g., first adjustment curve). As one example, during conditions in which the engine operates with the engine induction ratio of 1, the unadjusted phase rates of the camshaft phasers of the first cylinder bank may be a smaller, first amount, and during conditions in which the engine operates with the engine induction ratio of 0.25, the unadjusted phase rates of the camshaft phasers of the first cylinder bank may be scaled to a larger, second amount. As one example, a pulse width of electrical signals transmitted to the camshaft phasers of the first cylinder bank by the controller may be increased due to the scaled phase rates.

Although scaling the unadjusted phase rates of the camshaft phasers of the first cylinder bank is described above, the unadjusted phase rates of the camshaft phasers of the second cylinder bank are scaled in a similar way, but by a different amount. For example, in order to scale the unadjusted phase rates indicated by fifth plot 612 of FIG. 6 to the scaled phase rates indicated by fifth plot 812 of FIG. 8, the controller may determine a duty cycle of the control valves of the camshaft phasers of the second cylinder bank based on different functions or look-up tables stored in memory of the controller relative to those described above with reference to camshaft phasers of the first cylinder bank (e.g., according to the relationship between engine induction ratio and phase rate ratio shown by FIG. 7, as shown by second graph 702), with the duty cycle corresponding to the scaled phase rates scaled relative to the unadjusted phase rates by a second scaling factor. Specifically, because each of fifth plot 612 and fifth plot 812 indicate phase rates (e.g., unadjusted and scaled, respectively) of the camshaft phasers of the second cylinder bank at an engine induction ratio of 0.25, and because at location 726 along plot 706 shown by FIG. 7 the induction ratio is 0.25 and the phase rate ratio is approximately 0.52 in one example, the controller may determine the duty cycle of the control valves of the camshaft phasers of the second cylinder bank in order to scale the unadjusted phase rates by the second scaling factor (e.g., approximately 192% in this example) during conditions in which the engine induction ratio is 0.25 in order to enable the phase rates of the camshaft phasers of the second cylinder bank to be approximately the same as phase rates associated with the engine induction ratio of 1. However, during conditions in which the engine induction ratio is a different amount less than 1 (e.g., 0.50), the second scaling factor may be a different amount according to the plot 706 (e.g., second adjustment curve). As one example, during conditions in which the engine operates with the engine induction ratio of 1, the unadjusted phase rates of the camshaft phasers of the second cylinder bank may be a smaller, third amount, and during conditions in which the engine operates with the engine induction ratio of 0.25, the unadjusted phase rates of the camshaft phasers of the second cylinder bank may be scaled by the controller to a larger, fourth amount. As one example, a pulse width of electrical signals transmitted to the camshaft phasers of the second cylinder bank by the controller may be increased due to the scaled phase rates.

In some examples, the scaling factors applied to scale the duty cycles of the camshaft phasers may be further based on an operating temperature of the engine. For example, during conditions in which engine operating temperature is relatively high (e.g., as determined by the controller in response to electrical signals transmitted to the controller by one or more engine temperature sensors), the scaling factors applied to scale the duty cycles may be shifted to lower values (e.g., decreased). In another example, during conditions in which engine operating temperature is relatively low, the scaling factors applied to scale the duty cycles may be shifted to higher values (e.g., increased). The amount by which the scaling factors are increased or decreased may be a same amount for each scaling factor (e.g., for each camshaft phaser) based on the engine operating temperature. For example, based on the engine operating temperature, the scaling factors for camshaft phasers of both cylinder banks may be increased or decreased by a same amount.

By correcting (e.g., scaling) the phase rates of the camshaft phasers of the first cylinder bank and second cylinder bank separately as described above, the engine may operate at a plurality of different induction ratios while maintaining approximately a same phase rate of the camshaft phasers. Further, the engine ratio of the engine may be adjusted (e.g., by adjusting which cylinders of the engine are activated or deactivated via the controller) while maintaining substantially the same phase rate for the camshaft phasers (e.g., the rate at which the camshaft phasers adjust the phase of the camshafts) throughout the adjustment. In some examples, maintaining the phase rate at substantially the same rate includes increasing the scaling of the phase rates (e.g., the scaling of the actuating signals transmitted to the camshaft phasers) while decreasing the engine induction ratio, and decreasing the scaling of the phase rates while increasing the engine induction ratio.

For example, as indicated by arrow 828 shown by FIG. 8, the difference between the scaled phase rates associated with the engine induction ratio of 0.25 (e.g., indicated by first plot 804) and the phase rates associated with the engine induction ratio of 1 (e.g., indicated by fourth plot 610) is less than the difference (indicated by arrow 628 of FIG. 6) between the unadjusted phase rates associated with the engine induction ratio of 0.25 (e.g., indicated by first plot 604 shown by FIG. 6) and the phase rates associated with the engine induction ratio of 1 (e.g., indicated by fourth plot 610 shown by FIG. 6). Further, as indicated by arrow 830 shown by FIG. 8, the difference between the scaled phase rates (e.g., corrected phase rates) associated with the engine induction ratio of 0.25 (e.g., indicated by fifth plot 812) and the phase rates associated with the engine induction ratio of 1 (e.g., indicated by eighth plot 618) is less than the difference (indicated by arrow 630 of FIG. 6) between the unadjusted phase rates associated with the engine induction ratio of 0.25 (e.g., indicated by fifth plot 612 shown by FIG. 6) and the phase rates associated with the engine induction ratio of 1 (e.g., indicated by eighth plot 618 shown by FIG. 6).

In one example, the engine may operate in a rolling variable displacement mode, as described above with reference to FIG. 5. While operating in the rolling variable displacement mode, the engine may have a different engine induction ratio for different combustion cycles, with each combustion cycle corresponding to 720 degrees of crankshaft rotation. For example, during a first complete combustion cycle of the engine in the rolling variable displacement mode, the engine induction ratio may be 1. During a second complete combustion cycle immediately following the first complete combustion cycle (e.g., with no combustion cycles therebetween), the engine induction ratio may be 0.25, and during a third complete combustion cycle immediately following the second complete combustion cycle (e.g., with no combustion cycles therebetween), the engine induction ratio may be 0.75.

In some examples, the controller may determine an induction ratio of the engine for more than one complete combustion cycle during conditions in which the engine is operating in the rolling variable displacement mode. In such examples, the induction ratio may be a different amount than the induction ratios described above. For example, the controller may determine the induction ratio for the engine for two or more complete combustion cycles, with the induction ratio being the number of cylinders activated during the two or more complete combustion cycles relative to the total number of cylinders. In one example, the engine may include a total of six cylinders, with only three of the cylinders being activated during a first complete combustion cycle and with only two of the cylinders being activated during a second complete combustion cycle immediately following the first complete combustion cycle. The controller may determine that the induction ratio is 5/12 for the duration of the two complete combustion cycles, and the determined induction ratio may be utilized in order to adjust operation of the camshaft phasers as described herein.

As another example, only two of the cylinders may be activated during a first complete combustion cycle, only three of the cylinders may be activated during a second complete combustion cycle immediately following the first complete combustion cycle, and only two of the cylinders may be activated during a third complete combustion cycle immediately following the second complete combustion cycle. As a result, the controller may determine that the induction ratio is 7/18 for the duration of the three complete combustion cycles, and the controller may utilize the determined induction ratio to adjust operation of the camshaft phasers as described herein (e.g., with respect to the methods illustrated by FIG. 9 and/or FIG. 10).

In order to compensate for the different, unadjusted phase rates of the camshaft phasers resulting from the varying amounts of torque applied to the camshafts due to the different engine induction ratios (e.g., as described further above with reference to cam torque actuated camshaft phaser 200), the controller corrects (e.g., scales) the unadjusted phase rates based on the engine induction ratios as described above (e.g., scaling the phase rates of the camshaft phasers of the first cylinder bank differently than the phase rates of the camshaft phasers of the second cylinder bank).

In some examples, the controller may further correct the unadjusted phase rates based on the particular cylinders that are activated during the determination of the induction ratio.

The controller may correct the unadjusted phase rates by a different amount during conditions in which the induction ratio is 0.5 based on the relative arrangement of the activated cylinders of the engine. As one example, during conditions in which a different amount of cylinders are activated at a first cylinder bank of the engine relative to a second cylinder bank of the engine and the induction ratio is 0.5 (e.g., such as conditions in which the engine includes two cylinders banks having four cylinders each, with only three cylinders of the first cylinder bank being activated and only one cylinder of the second cylinder bank being activated), the controller may correct the unadjusted phase rates by a different amount relative to conditions in which a same number of cylinders are activated at the first and second cylinder banks and the induction ratio is 0.5 (e.g., with only two cylinders of the first bank being activated and only two cylinders of the second bank being activated).

In another example, the engine may include two cylinder banks having four cylinders each, with the cylinders of the first bank being in an inline arrangement (e.g., aligned with each other and positioned along a same first axis), and with the cylinders of the second bank also being in an inline arrangement (e.g., aligned with each other and positioned along a same second axis, the second axis parallel to the first axis). For example, the first bank may include two inner cylinders, with the inner cylinders positioned adjacent to each other and flanked by two outer cylinders. The second bank may include a similar cylinder arrangement.

During conditions in which the induction ratio is 0.5 (for example) due to the two inner cylinders of the first bank and the two outer cylinders of the second bank being deactivated and the two outer cylinders of the first bank and the two inner cylinders of the second bank being activated, the controller may correct the unadjusted phase rates by a different amount relative to conditions in which the induction ratio is 0.5 due to the two inner cylinders of the first bank and the two outer cylinders of the second bank being activated and the two outer cylinders of the first bank and the two inner cylinders of the second bank being deactivated. Additionally, other examples are possible, with the controller correcting the unadjusted phase rates by different amounts for different permutations of cylinders that are activated and/or deactivated and resulting in a same induction ratio. For example, the controller may correct the unadjusted phase rates by a first amount during conditions in which a first relative arrangement of activated cylinders results in a first induction ratio (e.g., 0.75), and the controller may correct the unadjusted phase rates by a different, second amount during conditions in which a second relative arrangement of activated cylinders results in the same, first induction ratio (e.g., 0.75), with the first relative arrangement being different than the second relative arrangement.

While operating the engine with an induction ratio less than 1, the scaled phase rates of the camshaft phasers of the first cylinder bank may more closely approximate (e.g., be substantially the same as) the phase rates of the camshaft phasers of the first cylinder bank associated with the engine induction ratio of 1, and the scaled phase rates of the camshaft phasers of the second cylinder bank may more closely approximate (e.g., be substantially the same as) the phase rates of the camshaft phasers of the second cylinder bank associated with the engine induction ratio of 1. Similarly, while operating the engine with an induction ratio less than 1, the changes to the scaled phase rates of the camshaft phasers of the first cylinder bank may more closely approximate (e.g., be substantially the same as) the changes to the phase rates of the camshaft phasers of the first cylinder bank associated with the engine induction ratio of 1, and changes to the scaled phase rates of the camshaft phasers of the second cylinder bank may more closely approximate (e.g., be substantially the same as) changes to the phase rates of the camshaft phasers of the second cylinder bank associated with the engine induction ratio of 1. For example, for different engine operating temperatures, the phase rates of the camshaft phasers of the first cylinder bank may change by substantially a same amount for conditions in which the engine induction ratio is less than 1, relative to conditions in which the engine induction ratio is 1. Similarly, for different engine operating temperatures, the phase rates of the camshaft phasers of the second cylinder bank may change by substantially a same amount for conditions in which the engine induction ratio is less than 1, relative to conditions in which the engine induction ratio is 1.

Selectively activating and/or deactivating engine cylinders via the controller as described above results in a reduced amount of variation of camshaft phaser phase rates relative to systems that do not scale the phase rates based on the engine induction ratio. As a result, operation of the cam torque actuated camshaft phasers may be more consistent and/or predictable for a wider variety of engine induction ratios and/or engine types. Engines that may normally include electrically actuated camshaft phasers, for example, may instead include cam torque actuated camshaft phasers adjusted by the controller as described above. Power consumption of the engine may thereby be reduced and phase rates may be increased, resulting in increased engine performance.

Additionally, by adjusting (e.g., correcting) the phase rates of the camshaft phasers of each cylinder bank separately, operation of the camshaft phasers may be adjusted to compensate for different manufacturing tolerances for each cylinder bank, part-to-part variability (e.g., variation in components of the first cylinder bank relative to the second cylinder bank), differences in an oil supply system for each cylinder bank (e.g., a relative shape and/or arrangement of oil passages), etc. Additionally, adjusting the phase rates of the camshaft phasers of each cylinder bank separately may compensate for different torque profiles of each cam. For example, although the cams of both cylinder banks may spin (e.g., rotate) in a same direction, and the valves driven by the cams are often positioned symmetrically relative to a center of the engine (e.g., a midpoint between the two cylinder banks), the lobes of cams of the first bank may engage with corresponding rocker arms at an opposite side of the rocker arms relative to lobes of cams of the second bank. This difference in engagement may affect the forces and torques produced by the cams of the different cylinder banks, and adjusting the phase rates of the camshaft phasers of each cylinder bank separately may enable the camshaft phasers of each cylinder bank to operate more consistently relative to each other.

Figure 9:
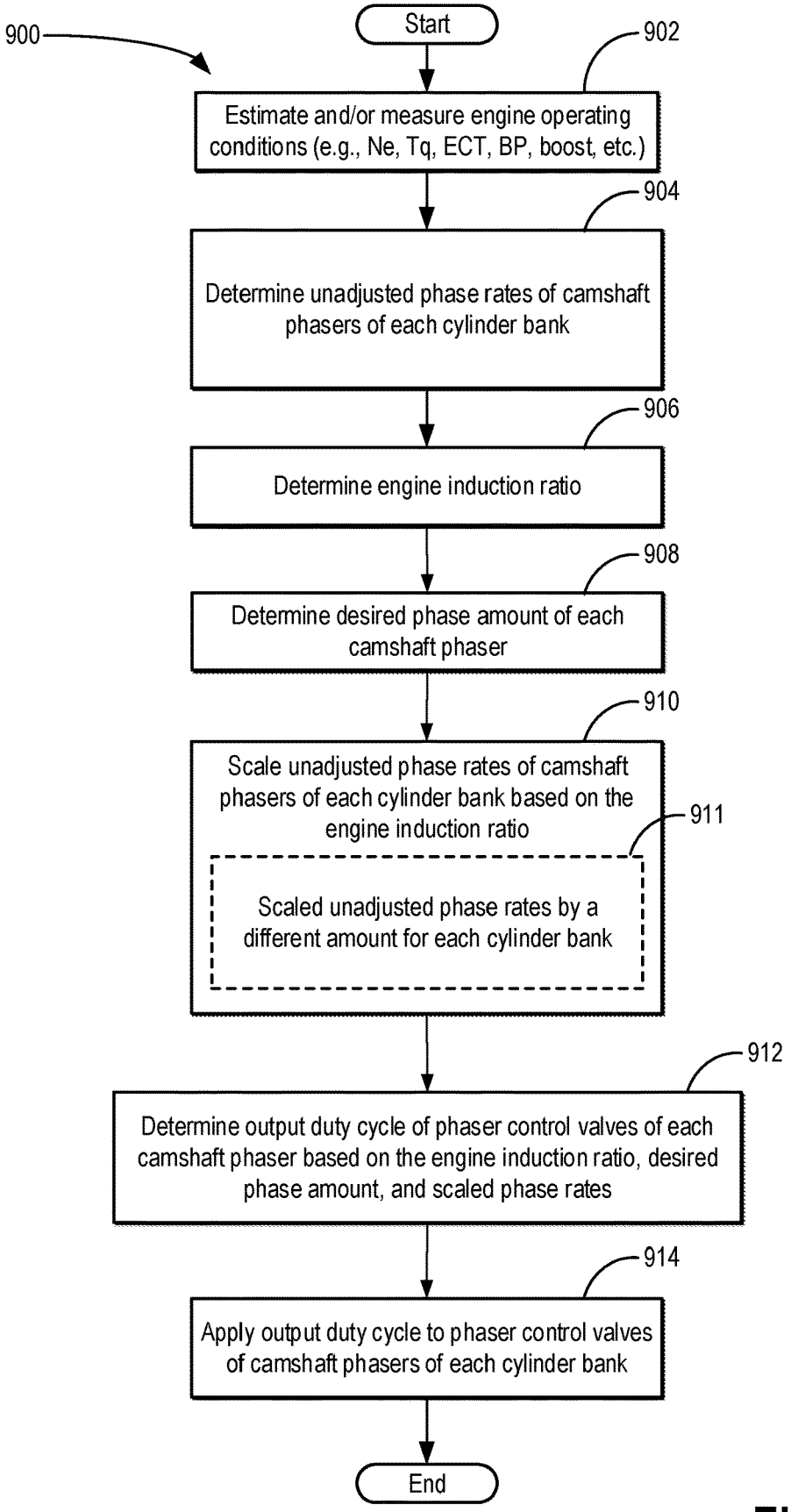
FIG. 9 illustrates a method for adjusting operation of camshaft phasers of an engine based on an induction ratio of the engine.

FIG. 9 illustrates a method 900 for controlling (e.g., adjusting) operation (e.g., phase and/or phase rate) of camshaft phasers of an engine based on an induction ratio of the engine. In one example, the engine may be similar to the engine 10 shown by FIG. 1 and described above, and the camshaft phasers may be similar to intake camshaft phaser 195 and/or exhaust camshaft phaser 196 shown by FIG. 1 and described above, and/or camshaft phaser 200 shown by FIG. 2 and described above. Instructions for carrying out method 900 and the rest of the methods included herein may be executed by a controller (e.g., controller 12 shown by FIG. 1 and described above) based on instructions stored on a memory of the controller and in conjunction with signals received from sensors of the engine system, such as the sensors described above with reference to FIG. 1. The controller may employ engine actuators of the engine system to adjust engine operation, according to the methods described below.

As described below, the controller may request an unadjusted phase rate of the camshaft phasers based on a tracking error of the cam phase angle (e.g., as measured by a camshaft position sensor such as position sensors 173 and/or 175 described above with reference to FIG. 1), and the unadjusted rate is mapped to a duty cycle applied to one or more phaser control valves. The intermediate mapping of the requested unadjusted phase rate and the duty cycle compensates for a nonlinear response of the camshaft phasers. For example, the phase rate and duty cycle relationship (even when operating the engine with all cylinder activated) may not be proportional and influenced by engine oil temperature (e.g., engine operating temperature). For conventional variable displacement engines (e.g., engines that do not include controllers configured to adjust the phase rates based on engine induction ratio) where only a few firing patterns are used (e.g., a V8 engine turning off 2 or 4 cylinders at a time), the nonlinear response of the camshaft phasers is often addressed by calibrating specific maps for each cylinder deactivation pattern. However, individual mapping of every cylinder deactivation pattern may not be possible as the number of possible patterns increases.

The methods disclosed herein address the above issues by modifying operation of the camshaft phasers in response to changes in engine induction ratio for a wider variety of cylinder firing patterns. The engine induction ratio is determined, which is the number of cylinders currently being used (e.g., activated cylinders) divided by the total number of engine cylinders (e.g., the sum of the activated and deactivated cylinders). The engine induction ratio may be continuously variable in some examples because firing patterns may take many combustion cycles to repeat. For example, as described above, the controller may determine the induction ratio of the engine for more than one complete combustion cycle during conditions in which the engine is operating in the rolling variable displacement mode. The determined engine induction ratio is utilized by the controller to determine an amount to scale the requested, unadjusted phase rates. Further, a duty cycle used to maintain a position (e.g., phase) of the camshaft phasers is affected by the engine induction ratio, and the controller may shift (e.g., adjust) the duty cycle based on the engine induction ratio. The amount by which the duty cycle is shifted may be determined using a lookup table stored in non-transitory memory of the controller (e.g., with the table including engine induction ratio as an input parameter and change to duty cycle as an output), and the shifted duty cycle is applied to the control valves of the camshaft phasers.

At 902, the method includes estimating and/or measuring engine operating conditions. For example, engine operating conditions may include engine operating temperature, engine speed, engine torque output, boost pressure, engine torque demand, throttle position, camshaft phase (e.g., relative to a crankshaft of the engine, such as crankshaft 140 shown by FIG. 1 and described above), camshaft phase rate, etc. The controller may estimate and/or measure the engine operating conditions based on an output of one or more sensors of the engine (e.g., the sensors described above with reference to FIG. 1). For example, the controller may measure the engine operating temperature based on an output of one or more engine coolant temperature sensors (e.g., temperature sensor 116 shown by FIG. 1 and described above). In one example, the controller may receive signals (e.g., electrical signals) from the engine coolant temperature sensor and may determine the engine operating temperature based on the received signals using one or more look-up tables stored in the memory of the controller, with an input being pulse width of signals transmitted to the controller by the engine coolant temperature, and with an output being engine operating temperature. In another example, the controller may make a logical determination (e.g., regarding the engine operating temperature) based on logic rules that are a function of the measured engine coolant temperature.

The method continues from 902 to 904 where the method includes determining unadjusted phase rates of camshaft phasers of each cylinder bank. For example, at 902, the controller may receive signals (e.g., electrical signals) from position sensors of camshafts of the engine (e.g., position sensors 173 and/or 175 described above with reference to FIG. 1), and at 904, the controller may determine the unadjusted phase rates of the camshaft phasers of each cylinder bank based on the received signals from the position sensors. As referred to herein, the unadjusted phase rates of the camshaft phasers refers to phase rates of the camshaft phasers during conditions in which the phase rates are not adjusted by the controller based on an induction ratio of the engine.

As one example, during conditions in which each cylinder of the engine is activated (e.g., the engine is on and a mixture of fuel and air is combusted in each cylinder), the engine induction ratio is 1 (e.g., with the number of activated cylinders being equal to the total number of cylinders). As a result, the controller may not adjust the phase rates of the camshaft phasers based on the induction ratio. During such conditions, the engine may determine the unadjusted phase rates of the camshaft phasers of each cylinder bank based on the output of the camshaft position sensors by comparing the output of the position sensors with a commanded phase rate of the camshaft phasers (e.g., commanded by the controller). For example, the controller may command the camshaft phasers of a first cylinder bank of the engine to advance a phase of the camshafts of the first cylinder bank at a desired rate by adjusting (e.g., increasing or decreasing) a duty cycle of control valves of the camshaft phasers of the first cylinder bank, and the controller may monitor the output of the camshaft position sensors of the camshafts of the first cylinder bank in response to the commanded phase advancement in order to determine the actual (e.g., unadjusted) phase rate of the camshaft phasers of the first cylinder bank (e.g., the rate at which the camshaft phasers adjust the phase of the camshafts). The controller performs a similar determination for each cylinder bank of the engine (e.g., determining the unadjusted phase rates of the camshaft phasers of the first cylinder bank as described above, and additionally determining unadjusted phase rates of camshaft phasers of a second cylinder bank including a similar set of camshafts and camshaft phasers).

As another example, the unadjusted phase rates may be pre-determined and stored in one or more lookup tables or functions within a memory of the controller. For example, one table may include camshaft phaser control valve duty cycle as an input, with the output being unadjusted phase rate of the camshaft phaser. The controller at 904 may determine the unadjusted phase rates by referencing unadjusted phase rate values stored in the lookup table associated with the duty cycle of the control valves of the camshaft phasers.

The method continues from 904 to 906 where the method includes determining an engine induction ratio. As described herein, the engine induction ratio refers to a ratio of activated cylinders of the engine to the total number of cylinders of the engine. For example, the engine may include a total of six cylinders, with three cylinders disposed within a first cylinder bank and three cylinders disposed within an opposing, second cylinder bank, as described above with reference to FIGS. 4-5. During conditions in which the engine operates with two cylinders deactivated, the engine induction ratio is 4/6 or approximately 0.66 (e.g., 4 activated cylinders relative to 6 total cylinders). As another example, during conditions in which the engine operates with four cylinders deactivated, the engine induction ratio is 2/6 or approximately 0.33 (e.g., 2 activated cylinders relative to 6 total cylinders). The engine induction ratio may be determined for a current, repeatable cycle of the engine. For example, at 906, the engine induction ratio may be determined for a current, single complete combustion cycle of the engine corresponding to 720 degrees of crankshaft rotation (e.g., similar to first duration 502, second duration 504, etc. described above with reference to FIG. 5). In another example, engine induction ratio may be determined for more than one complete combustion cycle (e.g., during conditions in which the engine is operating in the rolling variable displacement mode, as described above).

Further, at 906, the controller may determine the engine induction ratio for one or more upcoming complete combustion cycles of the engine (e.g., one or more complete combustion cycles following the current combustion cycle, such as determining the engine induction ratio for each of the first through eighth durations described above with reference to FIG. 5). In one example, the engine may be operating in a rolling variable displacement mode, wherein the engine induction ratio is continually adjusted by the controller responsive to changes in engine operating conditions (e.g., torque demand, boost pressure, etc.). In such examples, the controller may pre-determine the engine induction ratio for a plurality of upcoming combustion cycles. For example, at 906, the controller may determine that the engine induction ratio of the current combustion cycle is 0.66, and may further determine that the engine induction ratio for the next complete combustion cycle is 0.33, with the next complete combustion cycle occurring after 720 degrees of crankshaft rotation relative to a start of the current combustion cycle.

The method continues from 906 to 908 where the method includes determine a desired phase amount of each camshaft phaser. For example, at 908, the controller may make a determination regarding whether to advance and/or retard a phase of one or more of the camshafts (e.g., relative to the crankshaft of the engine) via the camshaft phasers based on the engine operating conditions described above. In one example, the controller may determine that advancing one or more of the camshafts via the camshaft phasers is desired (e.g., advancing one or more intake camshafts in order to reduce airflow into engine cylinders during lower engine operating speeds). In another example, the controller may determine that retarding one or more of the camshafts via the camshaft phasers is desired (e.g., retarding one or more of the exhaust camshafts in order to increase an amount of intake valve and exhaust valve opening overlap to increase a flow of intake air into cylinders during higher engine operating speeds). In yet another example, the controller may determine to maintain a phase of one or more of camshafts (e.g., in order to maintain current engine operating conditions). The controller may determine a change in duty cycle to be applied to control valves of the corresponding camshaft phasers in order to achieve the desired adjustment to the phase of the camshafts (e.g., change in angle of the camshafts relative to the crankshaft) via the camshaft phasers.

The method continues from 908 to 910 where the method includes scaling the unadjusted phase rates of the camshaft phasers of each cylinder bank based on the engine induction ratio. For example, as described above with reference to FIGS. 6-8, the unadjusted phase rates of the camshaft phasers may be scaled by the controller by different amounts for different engine induction ratios. During conditions in which the engine operates at a lower induction ratio (e.g., 2/6), the unadjusted phase rates of the camshaft phasers may be lower than phase rates during conditions in which the induction ratio is greater (e.g., 4/6). As a result, the phase rates at the lower induction ratio may be scaled by a greater amount that the phase rates at the higher induction ratio.

The ratio of the phase rates of the camshaft phasers at induction ratios less than 1 to the phase rates of the camshaft phasers at the engine induction ratio of 1 is decreased as the engine induction ratio decreases. For example, during conditions in which the engine induction ratio is 2/6 (e.g., approximately 0.33), the unadjusted phase rate of the camshaft phasers of the first cylinder bank may be approximately 65% of the phase rate during conditions in which the engine induction ratio is 1. As another example, during conditions in which the engine induction ratio is 4/6 (e.g., approximately 0.66), the unadjusted phase rate of the camshaft phasers of the first cylinder bank may be approximately 87% of the phase rate during conditions in which the engine induction ratio is 1. As a result, in order to achieve approximately a same phase rate for each induction ratio, the unadjusted phase rates associated with the engine induction ratio of 2/6 are scaled by a larger amount than the unadjusted phase rates associated with the engine induction ratio of 4/6.

Further, in some examples, as indicated at 911, scaling the unadjusted phase rates of the camshaft phasers includes scaling the phase rates differently for each cylinder bank. For example, as described above with reference to FIGS. 6-8, the unadjusted phase rates of camshaft phasers of a first cylinder bank may be different than unadjusted phase rates of camshaft phasers of a second cylinder bank for a same engine induction ratio. As a result, the controller may scale the unadjusted phase rates of the camshaft phasers of the different cylinder banks by different amounts. For example, as shown by FIG. 7, phase rates of camshaft phasers of the second cylinder bank decrease at a greater rate with decreasing engine induction ratio relative to phase rates of camshaft phasers of the first cylinder bank. In this example, the unadjusted phase rates of the camshaft phasers of the second cylinder bank may be scaled by a larger amount for a larger variety of engine induction ratios than the unadjusted phase rates of the camshaft phasers of the first cylinder bank.

The method continues from 910 to 912 where the method includes determining an output duty cycle of phaser control valves of each camshaft phaser based on the engine induction ratio, desired phase amount, and scaled phase rates. For example, the controller may include tables or functions stored in non-transitory memory for determining the output duty cycle based on the determined engine induction ratio, the determined desired phase amount, and the scaled phase rates. In one example, the controller determines the output duty cycle with a table including the determined engine induction ratio, the determined desired phase amount, and the scaled phase rates as inputs, and including the output duty cycle as an output of the table. As another example, the controller may make a logical determination (e.g., regarding the output duty cycle) based on logic rules that are a function of parameters including the determined engine induction ratio, the determined desired phase amount, and the scaled phase rates. The controller may then generate a control signal (e.g., pulse width modulated actuating signal) that is sent to control valves of the camshaft phasers, as described below at 914. Further, in some examples, the output duty cycle may be additionally based on engine operating temperature. For example, the output duty cycle may be scaled by an additional scaling factor, with the additional scaling factor being a function of engine temperature (e.g., engine oil temperature and/or engine coolant temperature).

The method continues from 912 to 914 where the method includes applying the output duty cycle to phaser control valves of camshaft phasers of each cylinder bank. For example, the controller may transmit signals (e.g., electrical pulses) to an actuator of the control valves (e.g., pulse width modulated variable force solenoid 207 shown by FIG. 2 and described above) in order to apply the output duty cycle to the phaser control valves (e.g., adjust the duty cycle of the phaser control valves to the output duty cycle). As described above, in some examples, the duty cycle applied to phaser control valves of camshaft phasers of different cylinder banks may be different. In one example, the output duty cycle applied to phaser control valves of camshaft phasers of the first cylinder bank may be less than the output duty cycle applied to phaser control valves of camshaft phasers of the second cylinder bank.

By adjusting the operation of the camshaft phasers as described above with regard to method 900, engine performance may be increased. For example, during conditions in which the engine operates at an induction ratio of less than 1 (e.g., with one or more cylinders deactivated), the phase rates of the cam torque actuated camshaft phasers may be increased to be approximately a same amount as phase rates at the induction ratio of 1 (e.g., with all cylinders activated). In this way, a response time of the camshaft phasers is reduced (e.g., a response time to adjustments to the camshaft phasers commanded by the controller), and combustion stability may be increased.

Figure 10:
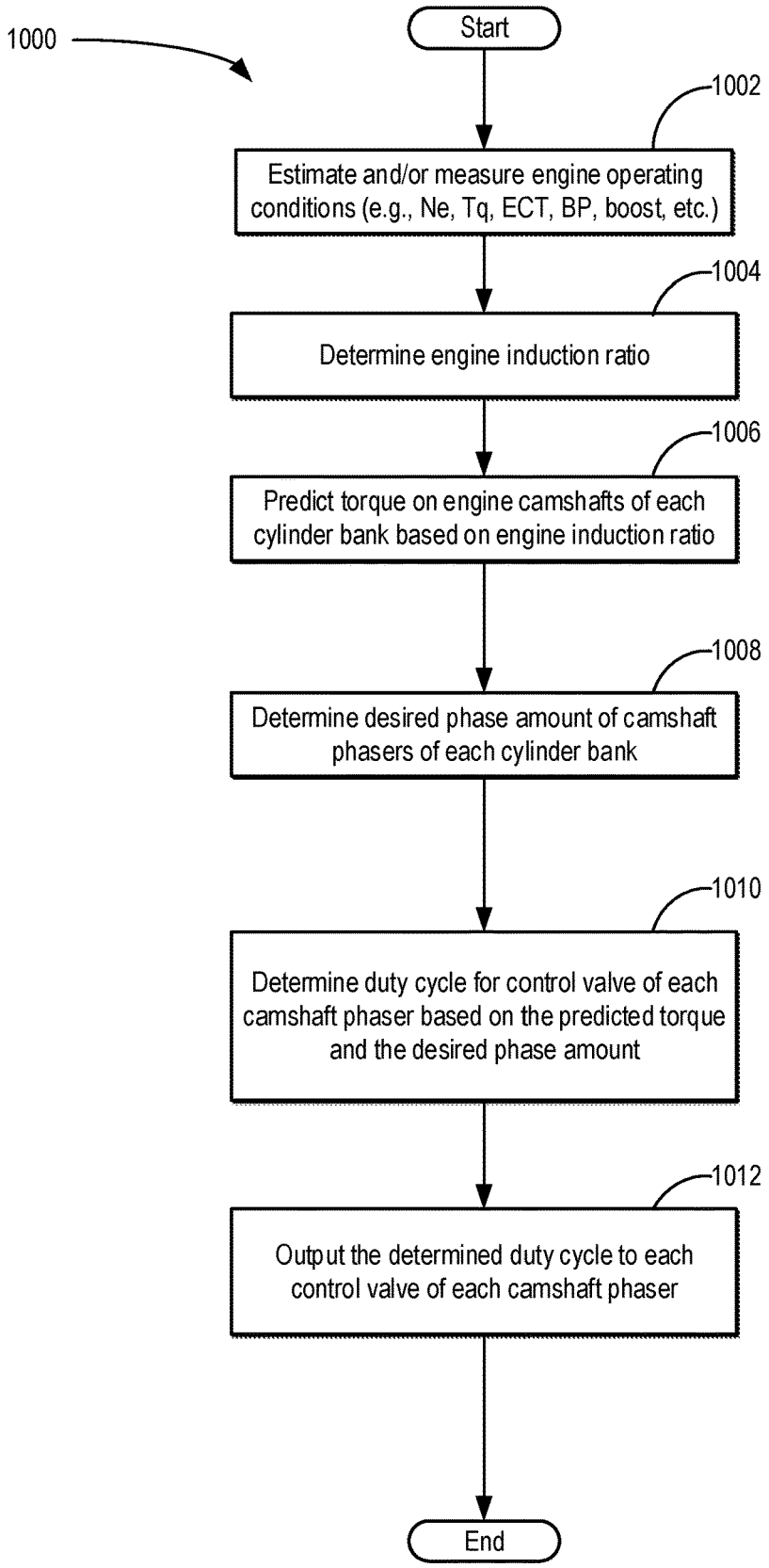
FIG. 10 illustrates a second method for adjusting operation of camshaft phasers of an engine based on an induction ratio of the engine.

FIG. 10 illustrates a second method 1000 for controlling (e.g., adjusting) operation of camshaft phasers of an engine based on an induction ratio of the engine. In one example, the engine may be similar to the engine 10 shown by FIG. 1 and described above. As described above, instructions for carrying out method 1000 may be executed by a controller (e.g., controller 12 shown by FIG. 1 and described above) based on instructions stored on a memory of the controller and in conjunction with signals received from sensors of the engine system, such as the sensors described above with reference to FIG. 1. The controller may employ engine actuators of the engine system to adjust engine operation, according to the methods described below.

With regard to the method 1000, cam phasing may be considered on an event by event basis. For example, a model may be used to predict potential cam movement in response to current valve events (e.g., intake valve and/or exhaust valve opening and/or closing), and the controller then commands a duty cycle to control valves of the camshaft phasers corresponding to a fraction of the potential cam movement desired to achieve the desired phase rate. In some examples, a table stored in non-transitory memory of the controller may be used by the controller to map the desired movement fraction to the duty cycle. Because the cam torque actuated camshaft phasers isolate and utilize torque pulses in the desired phase direction, the controller may predict energy available for phasing in each direction by separately integrating the positive and negative areas of the cam torque curve predicted for various engine induction ratios. A relationship between the energy available (e.g., the area computed) and maximum phase rate (e.g., the maximum event based movement) may be saved in a lookup table and used by the controller to compute the duty cycle based on the desired movement fraction, as described above.

At 1002, the method includes estimating and/or measuring engine operating conditions. For example, as described above at 902 of method 900, the engine operating conditions may include engine operating temperature, engine speed, engine torque output, boost pressure, engine torque demand, throttle position, camshaft phase (e.g., relative to a crankshaft of the engine, such as crankshaft 140 shown by FIG. 1 and described above), camshaft phase rate, which cylinders are activated or deactivated, etc. The controller may estimate and/or measure the engine operating conditions based on an output of one or more sensors of the engine (e.g., the sensors described above with reference to FIG. 1). For example, the controller may measure the engine operating temperature based on an output of one or more engine coolant temperature sensors (e.g., temperature sensor 116 shown by FIG. 1 and described above). In one example, the controller may receive signals (e.g., electrical signals) from the engine coolant temperature sensor and may determine the engine operating temperature based on the received signals using one or more look-up tables stored in the memory of the controller, with an input being pulse width of signals transmitted to the controller by the engine coolant temperature, and with an output being engine operating temperature. In another example, the controller may make a logical determination (e.g., regarding the engine operating temperature) based on logic rules that are a function of the measured engine coolant temperature. In another example, the controller may determine which cylinders are activated or deactivated based on a state (e.g., mode) of valves of each cylinder (e.g., whether the intake valves and exhaust valves associated with each cylinder are activated or deactivated).

The method continues from 1002 to 1004 where the method includes determining the engine induction ratio. As described above at 906 of method 900, the engine induction ratio refers to a ratio of activated cylinders of the engine to the total number of cylinders of the engine. For example, the engine may include a total of six cylinders, with three cylinders disposed within a first cylinder bank and three cylinders disposed within an opposing, second cylinder bank, as described above with reference to FIGS. 4-5. During conditions in which the engine operates with two cylinders deactivated, the engine induction ratio is 4/6 or approximately 0.66 (e.g., 4 activated cylinders relative to 6 total cylinders). As another example, during conditions in which the engine operates with four cylinders deactivated, the engine induction ratio is 2/6 or approximately 0.33 (e.g., 2 activated cylinders relative to 6 total cylinders). The engine induction ratio may be determined for a current, repeatable cycle of the engine. For example, at 906, the engine induction ratio may be determined for a current, single complete combustion cycle of the engine corresponding to 720 degrees of crankshaft rotation (e.g., similar to first duration 502, second duration 504, etc. described above with reference to FIG. 5). In another example, the engine induction ratio may be determined for more than one complete combustion cycle (e.g., during conditions in which the engine is operating in the rolling variable displacement mode).

Further, at 1004, the controller may determine the engine induction ratio for one or more upcoming complete combustion cycles of the engine (e.g., one or more complete combustion cycles following the current combustion cycle, such as determining the engine induction ratio for each of the first through eighth durations described above with reference to FIG. 5). In one example, the engine may be operating in a rolling variable displacement mode, wherein the engine induction ratio is continually adjusted by the controller responsive to changes in engine operating conditions (e.g., torque demand, boost pressure, etc.). In such examples, the controller may pre-determine the engine induction ratio for a plurality of upcoming combustion cycles. For example, at 906, the controller may determine that the engine induction ratio of the current combustion cycle is 0.66, and may further determine that the engine induction ratio for the next complete combustion cycle is 0.33, with the next complete combustion cycle occurring after 720 degrees of crankshaft rotation relative to a start of the current combustion cycle.

The method continues from 1004 to 1006 where the method includes predicting a torque on engine camshafts of each cylinder bank based on the engine induction ratio. For example, a model (e.g., a function, table, etc. stored in non-transitory memory of the controller) may be utilized by the controller to predict torque (e.g., predict a torque curve or variations in torque) applied to the camshafts based on the engine induction ratio. As described above, at different engine induction ratios, torque applied to engine camshafts may differ. For example, during conditions in which one or more cylinders having valves driven via the camshafts are deactivated, the amount of torque applied to the camshafts by interaction of the cams of the camshafts with the valves (e.g., intake valves and/or exhaust valves) is reduced relative to conditions in which the one or more cylinders are not deactivated. The controller may predict (e.g., estimate) the torque applied to the camshafts for various engine induction ratios via the model, with an input being engine induction ratio and an output being camshaft torque. Because the cam torque actuated camshaft phasers isolate and utilize the torque pulses applied to the camshafts, predicting the torque applied to the camshafts at 1006 enables the controller to estimate an amount of energy available to each camshaft phaser for adjusting the phase of the corresponding camshafts in each direction. In one example, the controller may calculate the amount of energy available by separately integrating positive and negative areas of the predicted torque curve at the determined induction ratio. A relationship between the available energy and a maximum phase rate of the camshaft phasers (or maximum valve event based movement), may be stored in non-transitory memory of the controller (e.g., as a lookup table) and may be referenced by the controller in order to determine a duty cycle of control valves of the camshaft phasers, as described below.

Further, the controller may predict the torque on engine camshafts of each cylinder bank based on a relative arrangement of activated cylinders of each cylinder bank, similar to the examples described above with reference to FIG. 8. For example, for engine induction ratios that may result from multiple different arrangements of activated cylinders versus deactivated cylinders (e.g., an induction ratio of 0.5 for an eight cylinder engine having two cylinder banks with four cylinders each, where in one example only a first set of cylinders of the first bank are activated and only a first set of cylinders of the second bank are activated, and in another example only a different, second set of cylinders of the first bank are activated and only a different, second set of cylinders of the second bank are activated), the controller may predict a different amount of torque based on the arrangement of activated cylinders versus deactivated cylinders for each different arrangement.

The method continues from 1006 to 1008 where the method includes determining the desired phase rate of the camshaft phasers of each cylinder bank. As described above with reference to 908 of method 900, the controller may make a determination regarding whether to advance and/or retard a phase of one or more of the camshafts (e.g., relative to the crankshaft of the engine) via the camshaft phasers based on the engine operating conditions described above. In one example, the controller may determine that advancing one or more of the camshafts via the camshaft phasers is desired (e.g., advancing one or more intake camshafts in order to reduce airflow into engine cylinders during lower engine operating speeds). In another example, the controller may determine that retarding one or more of the camshafts via the camshaft phasers is desired (e.g., retarding one or more of the exhaust camshafts in order to increase an amount of intake valve and exhaust valve opening overlap to increase a flow of intake air into cylinders during higher engine operating speeds). In yet another example, the controller may determine to maintain a phase of one or more of camshafts (e.g., in order to maintain current engine operating conditions). The controller may determine a change in duty cycle to be applied to control valves of the corresponding camshaft phasers in order to achieve the desired adjustment to the phase of the camshafts (e.g., change in angle of the camshafts relative to the crankshaft) via the camshaft phasers.

The method continues from 1008 to 1010 where the method includes determining a duty cycle for control valves of each camshaft phaser based on the predicted torque and the desired phase amount. For example, the controller may reference a table stored in non-transitory memory of the controller, with inputs of the table being the desired phase amount and the predicted torque, and with an output of the table being the duty cycle of the control valves. In some examples, the duty cycles determined for control valves of camshaft phasers of a first cylinder bank of the engine may be different than the duty cycles determined for control valves of camshaft phasers of a second cylinder bank of the engine. For example, as shown by FIG. 7, although the phase rate of the camshaft phasers may tend to decrease for lower engine induction ratios (e.g., lower than 1) for each cylinder bank, the amount by which the phase rate decreases may be different for camshaft phasers of different cylinder banks. Accordingly, the predicted torque may be different for the camshaft phasers of the different cylinder banks, and as a result, the controller may determine different duty cycles for the control valves of the camshaft phasers of the different cylinder banks.

The method continues from 1010 to 1012 where the method includes outputting the determined duty cycle to each control valve of each camshaft phaser. In one example, as described above with reference to 914 of method 900, the controller may transmit electrical signals (e.g., pulse width modulated actuating signals) to an actuator of the control valves (e.g., pulse width modulated variable force solenoid 207 shown by FIG. 2 and described above) in order to output the duty cycle to the phaser control valves (e.g., adjust the duty cycle of the phaser control valves to the determined duty cycle). As described above, in some examples, the duty cycle output to the phaser control valves of the camshaft phasers of different cylinder banks may be different. In one example, the duty cycle output to phaser control valves of camshaft phasers of the first cylinder bank may be different (e.g., more or less) than the duty cycle output to phaser control valves of camshaft phasers of the second cylinder bank.

As illustrated by examples herein, the method of operating and performing actions responsive to a determination of a condition may include operating in that condition (e.g., operating with the engine in the rolling variable displacement mode), determining whether that condition is present (such as based on sensor output, e.g., determining that one or more cylinders of the engine are deactivated based on a torque output of the engine) and performing actions in response thereto, as well as operating without that condition present, determining that the condition is not present, and performing a different action in response thereto. For example, the controller may determine that the engine is operating in the rolling variable displacement mode, and may scale unadjusted phase rates of camshaft phasers in response to the determination of the engine operating in the rolling variable displacement mode. The controller may similarly determine that the engine is not operating in the rolling variable displacement mode, and may not scale the unadjusted phase rates of the camshaft phasers in response to the determination that the engine is not operating in the rolling variable displacement mode.

In this way, by configuring the engine to operate in the rolling variable displacement mode with camshaft phasers of the different cylinder banks adjusted differently based on the engine induction ratio, the camshaft phasers may be operated more consistently for a wider variety of engine induction ratios. Further, because the camshaft phasers are cam torque actuated camshaft phasers, the camshaft phasers may be quickly actuated regardless of engine oil pressure or engine speed. In particular, the camshaft phasers may operate reliably at lower engine speeds, with lower engine operating temperatures and/or lower engine oil pressures, such as during engine startup (e.g., cranking). Because the camshaft phasers are actuated by cam torque (e.g., camshaft torque pulses), an oil pump of the engine may be reduced in size relative to systems that include engine oil actuated camshaft phasers that are actuated via oil fed by the oil pump. As a result, engine efficiency (e.g., fuel economy) and engine performance may be increased.

The technical effect of adjusting the cam torque actuated camshaft phasers of each cylinder bank differently is to increase the phase rate of the camshaft phasers for a large variety of engine induction ratios, and in particular, during conditions in which the engine operates in a rolling variable displacement mode.

In one embodiment, a method comprises: controlling phasing of a first camshaft coupled to a first bank of an engine via a first phase timer; controlling phasing of a second camshaft coupled to a second bank of the engine via a second phase timer; and correcting the first and second phase timers by first and second corrections each based on an induction ratio of the engine, the first and second corrections being different for the same induction ratio. In a first example of the method, the method further comprises providing first and second pulse width modulated actuating signals via a controller to the respective first and second phase timers, and wherein the phasing provided by the first and second phase timers is related to a duty cycle of the first and second actuating signals. A second example of the method optionally includes the first example, and further includes wherein the first and second phase timer corrections are each provided by scaling the duty cycles of the first and second actuating signals in relation to the engine induction ratio, the scaling being different for the first and second camshafts. A third example of the method optionally includes one or both of the first and second examples, and further includes wherein the scaling of the duty cycles of the first and second actuating signals is increased as the induction ratio decreases. A fourth example of the method optionally includes one or more or each of the first through third examples, and further includes wherein the scaling of the duty cycles of the first and second actuating signals is based on adjustment curves stored in non-transitory memory of an electronic controller of the engine, the adjustment curves being different for the first and second camshafts. A fifth example of the method optionally includes one or more or each of the first through fourth examples, and further includes wherein the first and second phase timers are cam torque actuated phase timers. A sixth example of the method optionally includes one or more or each of the first through fifth examples, and further includes wherein correcting the first phase timer by the first correction includes: estimating a first amount of torque applied to the first camshaft based on the induction ratio, and providing a first pulse width modulated actuating signal via an electronic controller to the first phase timer based on the first amount of torque; and wherein correcting the second phase timer by the second correction includes: estimating a second amount of torque applied to the second camshaft based on the induction ratio, and providing a second pulse width modulated actuating signal via the controller to the second phase timer based on the second amount of torque. A seventh example of the method optionally includes one or more or each of the first through sixth examples, and further includes wherein the engine is a variable displacement engine having multiple cylinders and the induction ratio is a ratio of non-deactivated cylinders to a total number of the cylinders.

In another embodiment, a method comprises: determining which cylinders of a variable displacement engine are activated or deactivated; controlling phasing and phase rate of a first camshaft coupled to a first bank of the engine via a first phase timer responsive to a first actuating signal; controlling phasing and phase rate of a second camshaft coupled to a second bank of the engine via a second phase timer responsive to a second actuating signal; and scaling the first and second actuating signals in relation to a ratio of activated to total cylinders so that a change in phase rate when any number of the cylinders are deactivated is substantially the same as a change in phase rate when all the cylinders are activated, the scaling being different for the first and second camshafts. In a first example of the method, the method includes wherein the scaling of the first actuating signal is performed by an electronic controller of the engine via a first scaling factor related to a ratio of activated to total cylinders, scaling of the second actuating signals is performed by the controller via a second scaling factor also related to the ratio of activated to total cylinders, and the first scaling factor is different than the second scaling factor even when the ratio of activated to total cylinders is the same for each of the engine banks. A second example of the method optionally includes the first example, and further includes wherein the first scaling factor and second scaling factor are each adjusted by a same amount based on an operating temperature of the engine. A third example of the method optionally includes one or both of the first and second examples, and further includes wherein the first scaling factor is a first output of a first function or first look-up table stored in non-transitory memory of the controller, and wherein the second scaling factor is a second output of a different, second function or different, second look-up table stored in the non-transitory memory of the controller. A fourth example of the method optionally includes one or more or each of the first through third examples, and further includes wherein controlling the phasing and the phase rate of the first camshaft via the first phase timer includes adjusting a duty cycle of the first phase timer by transmitting the first actuating signal from an electronic controller of the engine to the first phase timer, and wherein controlling the phasing and the phase rate of the second camshaft via the second phase timer includes adjusting a duty cycle of the second phase timer by transmitting the second actuating signal from the controller to the second phase timer. A fifth example of the method optionally includes one or more or each of the first through fourth examples, and further includes wherein the first and second phase timers are cam torque actuated phase timers, with the duty cycle of the first phase timer determining a phase direction of the first camshaft and the duty cycle of the second phase timer determining a phase direction of the second camshaft. A sixth example of the method optionally includes one or more or each of the first through fifth examples, and further includes maintaining the phase rate of the first and second camshafts at substantially the same rate while adjusting which cylinders of the engine are activated or deactivated. A seventh example of the method optionally includes one or more or each of the first through sixth examples, and further includes wherein maintaining the phase rate of the first and second camshafts at substantially the same rate includes increasing the scaling of the first and second actuating signals while decreasing a number of activated cylinders and decreasing the scaling of the first and second actuating signals while increasing the number of activated cylinders.

In one embodiment, a system comprises: an engine; a first cylinder bank of the engine having a first plurality of cylinders disposed therein, the first plurality of cylinders including valves driven by a first camshaft; a second cylinder bank of the engine having a second plurality of cylinders disposed therein, the second plurality of cylinders including valves driven by a second camshaft; a first camshaft phaser coupled to the first camshaft; a second camshaft phaser coupled to the second camshaft; and an electronic controller including instructions stored in non-transitory memory for adjusting operation of the first camshaft phaser and second camshaft phaser independently of each other based on tables or functions stored in the memory of the controller, where an input parameter of the tables or functions is an induction ratio of the engine. In a first example of the system, the system further comprises instructions stored in the memory of the controller for determining the induction ratio of the engine based on a number of activated engine cylinders relative to a total number of engine cylinders. A second example of the system optionally includes the first example, and further includes wherein the first camshaft phaser and second camshaft phaser are each cam torque actuated camshaft phasers, and wherein an output of the tables or functions is a first adjustment curve of the first camshaft phaser and a different, second adjustment curve of the second camshaft phaser. A third example of the system optionally includes one or both of the first and second examples, and further includes wherein a pulse width of electrical signals provided by the controller to the first camshaft phaser is scaled based on the first adjustment curve, and a pulse width of electrical signals provided by the controller to the second camshaft phaser scaled is based on the second adjustment curve.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

controlling phasing of a first camshaft coupled to a first bank of an engine via a first phase timer;

controlling phasing of a second camshaft coupled to a second bank of the engine via a second phase timer; and correcting the first and second phase timers by first and second corrections, respectively, where each of the first and second corrections are based on an induction ratio of both the first bank and the second bank, with the first correction being different than the second correction.

2. The method of claim 1, further comprising providing first and second pulse width modulated actuating signals via a controller to the first and second phase timers, respectively, wherein the controlling of phasing provided by the first phase timer is related to a duty cycle of the first pulse width modulated actuating signal, and the controlling of phasing provided by the second phase timer is related to a duty cycle of the second pulse width modulated actuating signal.

3. The method of claim 2, wherein the first correction is provided by scaling the duty cycle of the first pulse width modulated actuating signal in relation to the induction ratio, and the second correction is provided by scaling the duty cycle of the second pulse width modulated actuating signal in relation to the induction ratio, with the scaling of the duty cycle of the first pulse width modulated actuating signal being different than the scaling of the duty cycle of the second pulse width modulated actuating signal.

4. The method of claim 3, wherein the scaling of the duty cycle of the first pulse width modulated actuating signal and the scaling of the duty cycle of the second pulse width modulated actuating signal is increased as the induction ratio decreases.

5. The method of claim 3, wherein the scaling of the duty cycle of the first pulse width modulated actuating signal is based on a first adjustment curve stored in non-transitory memory of an electronic controller of the engine, and the scaling of the duty cycle of the second pulse width modulated actuating signal is based on a different, second adjustment curve stored in the non-transitory memory of the electronic controller.

6. The method of claim 1, wherein the first and second phase timers are cam torque actuated phase timers.

7. The method of claim 6, wherein correcting the first phase timer by the first correction includes:

estimating a first amount of torque applied to the first camshaft based on the induction ratio, and providing a first pulse width modulated actuating signal via an electronic controller to the first phase timer based on the first amount of torque; and wherein correcting the second phase timer by the second correction includes:

estimating a second amount of torque applied to the second camshaft based on the induction ratio, and providing a second pulse width modulated actuating signal via the electronic controller to the second phase timer based on the second amount of torque.

8. The method of claim 1, wherein the engine is a variable displacement engine having multiple cylinders and the induction ratio is a ratio of activated cylinders of the multiple cylinders to a total number of the multiple cylinders.

9. A method, comprising:

determining which cylinders of a variable displacement engine are activated or deactivated;

controlling phasing and phase rate of a first camshaft coupled to a first bank of the engine via a first phase timer responsive to a first actuating signal;

controlling phasing and phase rate of a second camshaft coupled to a second bank of the engine via a second phase timer responsive to a second actuating signal; and scaling the first and second actuating signals in relation to a ratio of activated cylinders of the first bank and the second bank to total cylinders of the first bank and the second bank such that a change in phase rate when a portion of the cylinders is deactivated is equal to a change in phase rate when all the cylinders are activated, the scaling of the first actuating signal being different than the scaling of the second actuating signal.

10. The method of claim 9, wherein the scaling of the first actuating signal is performed by an electronic controller of the engine via a first scaling factor related to the ratio of the activated cylinders of the first bank and the second bank to the total cylinders of the first bank and the second bank, scaling of the second actuating signal is performed by the electronic controller via a second scaling factor related to the ratio of the activated cylinders of the first bank and the second bank to the total cylinders of the first bank and the second bank, and the first scaling factor is different than the second scaling factor even when a total amount of activated cylinders of only the first bank of the engine is equal to a total amount of activated cylinders of only the second bank of the engine.

11. The method of claim 10, wherein the first scaling factor and the second scaling factor are each adjusted by a same amount based on an operating temperature of the engine.

12. The method of claim 10, wherein the first scaling factor is a first output of a first function or first look-up table stored in non-transitory memory of the electronic controller, and wherein the second scaling factor is a second output of a different, second function or different, second look-up table stored in the non-transitory memory of the electronic controller.

13. The method of claim 9, wherein the controlling of the phasing and the phase rate of the first camshaft via the first phase timer includes adjusting a duty cycle of the first phase timer by transmitting the first actuating signal from an electronic controller of the engine to the first phase timer, and wherein the controlling of the phasing and the phase rate of the second camshaft via the second phase timer includes adjusting a duty cycle of the second phase timer by transmitting the second actuating signal from the electronic controller to the second phase timer.

14. The method of claim 13, wherein the first and second phase timers are cam torque actuated phase timers, with the duty cycle of the first phase timer determining a phase direction of the first camshaft and the duty cycle of the second phase timer determining a phase direction of the second camshaft.

15. The method of claim 9, further comprising adjusting which cylinders of the engine are activated or deactivated while maintaining the phase rates of the first and second camshafts at equal rates throughout the adjustment.

16. The method of claim 15, wherein the maintaining of the phase rates of the first and second camshafts at equal rates includes:

responsive to decreasing a number of activated cylinders while adjusting which cylinders of the engine are activated or deactivated, increasing the scaling of the first actuating signal and the scaling of the second actuating signal; and responsive to increasing the number of activated cylinders while adjusting which cylinders of the engine are activated or deactivated, decreasing the scaling of the first actuating signal and the scaling of the second actuating signal.

17. A system, comprising:

an engine;

a first cylinder bank of the engine having a first plurality of cylinders, the first plurality of cylinders including valves driven by a first camshaft;

a second cylinder bank of the engine having a second plurality of cylinders, the second plurality of cylinders including valves driven by a second camshaft;

a first camshaft phaser coupled to the first camshaft;

a second camshaft phaser coupled to the second camshaft; and an electronic controller including instructions stored in non-transitory memory for adjusting operation of the first camshaft phaser and the second camshaft phaser independently of each other based on tables or functions stored in the memory of the electronic controller, where an input parameter of the tables or functions is an induction ratio of the first plurality of cylinders and the second plurality of cylinders.

18. The system of claim 17, further comprising instructions stored in the memory of the electronic controller for determining the induction ratio of the first plurality of cylinders and the second plurality of cylinders based on a number of activated cylinders of the first plurality of cylinders and the second plurality of cylinders relative to a total number of cylinders of the first plurality of cylinders and the second plurality of cylinders.

19. The system of claim 17, wherein the first camshaft phaser and the second camshaft phaser are each cam torque actuated camshaft phasers, and wherein an output of the tables or functions is a first adjustment curve of the first camshaft phaser and a different, second adjustment curve of the second camshaft phaser.

20. The system of claim 19, wherein a pulse width of electrical signals provided by the electronic controller to the first camshaft phaser is scaled based on the first adjustment curve, and a pulse width of electrical signals provided by the electronic controller to the second camshaft phaser is scaled based on the second adjustment curve.

* * * * *